US009533807B2

(12) United States Patent
Diguglielmo

(10) Patent No.: US 9,533,807 B2
(45) Date of Patent: Jan. 3, 2017

(54) APPARATUS AND ASSEMBLY FOR ROUTING SINGLE LENGTH OF FLEXIBLE RIBBON AROUND PACKAGE IN CROSSED CONFIGURATION, WITH APPARATUSES FOR SECURING AND CUTTING RIBBON

(71) Applicant: Joseph Diguglielmo, Chester Springs, PA (US)

(72) Inventor: Joseph Diguglielmo, Chester Springs, PA (US)

( * ) Notice: Subject to any disclaimer, the term of this patent is extended or adjusted under 35 U.S.C. 154(b) by 864 days.

(21) Appl. No.: 13/905,860

(22) Filed: May 30, 2013

(65) Prior Publication Data

US 2013/0318921 A1 Dec. 5, 2013

Related U.S. Application Data

(60) Provisional application No. 61/654,932, filed on Jun. 3, 2012, provisional application No. 61/732,936, filed on Dec. 4, 2012.

(51) Int. Cl.
*B65D 63/14* (2006.01)
*B65D 63/16* (2006.01)
(Continued)

(52) U.S. Cl.
CPC ..... *B65D 63/00* (2013.01); *B65B 13/00* (2013.01); *B65D 63/14* (2013.01); *B65D 63/16* (2013.01);
(Continued)

(58) Field of Classification Search
CPC ..... B65B 13/00; B65B 13/02; B65B 13/04; B65D 63/00; B65D 63/14; B65D 63/16; D04D 7/10; D04D 7/105; D04D 9/04; D04D 11/00; Y10T 24/14; Y10T 24/1402; Y10T 24/1406; Y10T 292/505
(Continued)

(56) References Cited

U.S. PATENT DOCUMENTS 332,925 A * 12/1885 McCarty ..... G09F 3/0352 292/325
1,093,096 A * 4/1914 Allen ..... B65D 63/1018 24/17 A
(Continued)

FOREIGN PATENT DOCUMENTS

CH 635796 A5 * 4/1983 ..... B65D 63/14
GB 111641 A * 12/1917 ..... B65D 63/14

*Primary Examiner* — Stephen F Gerrity
(74) *Attorney, Agent, or Firm* — Panitch Schwarze Belisario & Nadel LLP

(57) ABSTRACT

A ribbon routing assembly for routing a single length of ribbon around and securing the ribbon to an object. The ribbon has a first end and a second end. The ribbon routing assembly includes a body with a void. The body includes a first leg configured for securing to the first end of the ribbon and a second leg configured for securing to the second end of the ribbon. The void includes a routing edge that defines a first acute angle relative to the first leg and a second acute angle relative to the second leg. The first and second acute angles are approximately forty-five degrees. The body has a first surface and a second surface that define a thickness therebetween, the first leg defines a first length and the second leg defines a second length. A lid is configured for mounting to the body in a mounted configuration.

16 Claims, 46 Drawing Sheets

(51) Int. Cl.
*D04D 9/04* (2006.01)
*B65B 13/00* (2006.01)
*B65D 63/00* (2006.01)

(52) U.S. Cl.
CPC ..... *D04D 9/04* (2013.01); *Y10T 24/14* (2015.01); *Y10T 24/1402* (2015.01)

(58) Field of Classification Search
USPC 53/137.2, 138.1, 580, 582, 589, 590; 100/1, 8; 24/16 R, 17 R, 17 A; 292/325
See application file for complete search history.

(56) References Cited

U.S. PATENT DOCUMENTS 1,419,592 A * 6/1922 Sturges ..... A44B 11/10 24/17 A
1,476,520 A * 12/1923 Kaye ..... B65D 63/14 229/125.38
1,598,309 A 8/1926 Quinlan
1,808,636 A * 6/1931 Chesney ..... B65D 63/14 24/18
1,991,917 A * 2/1935 Bates ..... B65D 63/14 24/134 R
2,346,538 A * 4/1944 Kleinmann ..... B65D 63/14 229/125.22
2,643,424 A * 6/1953 Gothar ..... B65D 63/14 24/17 A
3,754,692 A 8/1973 Sanders
4,726,509 A 2/1988 Fonas
5,094,370 A 3/1992 Specht
5,509,586 A 4/1996 Leiser
5,655,802 A * 8/1997 Topp et al. ..... B65D 63/14 292/307 R
5,718,100 A * 2/1998 Petty ..... B65B 13/02 206/457
5,915,629 A * 6/1999 Ribeiro ..... B65D 63/16 24/16 R
6,360,411 B1 * 3/2002 Bortz ..... G09F 3/0311 24/625
6,684,462 B1 * 2/2004 Narula ..... B65D 63/14 24/115 R
7,607,278 B2 * 10/2009 Witkowski ..... B65B 27/08 100/1
7,845,689 B1 * 12/2010 Angele ..... G09B 19/0076 289/17
9,390,635 B2 * 7/2016 Vafadari ..... B65D 63/02
2010/0025438 A1 2/2010 Ranzau
2012/0229975 A1 * 9/2012 Yang ..... B65D 63/14 361/679.57
2013/0015214 A1 1/2013 Ranzau

* cited by examiner

APPARATUS AND ASSEMBLY FOR ROUTING SINGLE LENGTH OF FLEXIBLE RIBBON AROUND PACKAGE IN CROSSED CONFIGURATION, WITH APPARATUSES FOR SECURING AND CUTTING RIBBON

CROSS-REFERENCE TO RELATED APPLICATIONS

The present application claims priority to, and the benefit of, U.S. Provisional Patent Application No. 61/654,932, filed by this inventor on Jun. 3, 2012, and titled "APPARATUS, ASSEMBLY, AND METHOD FOR ROUTING SINGLE LENGTH OF RIBBON AROUND PACKAGE IN CROSSED CONFIGURATION, WITH APPARATUSES FOR ATTACHING, CUTTING, AND SECURING RIBBON", and U.S. Provisional Patent Application No. 61/732,936, filed by this inventor on Dec. 4, 2012, entitled "APPARATUS AND METHODS FOR USE IN INVENTION FOR ROUTING SINGLE LENGTH OF RIBBON AROUND PACKAGE IN CROSSED CONFIGURATION," the entire contents of each of which is incorporated herein by reference in its entirety.

BACKGROUND OF THE INVENTION

Briefly stated, preferred embodiments of the invention relate to an innovative apparatus, assembly, and method to route a single length of flexible ribbon around a package or object, or group thereof, in a crossed configuration at both the top and bottom faces of the package(s) or object(s).

Preferred embodiments of the present invention provide a pre-configured assembly, comprised of a routing apparatus or body, some preferred embodiments including a functional housing for the body, a pre-determined length of ribbon routed through and attached/attachable to the routing apparatus, and a decorative and/or functional item (such as a decorative bow or dry erase writing surface) affixed to the top of the routing apparatus' functional housing. With this pre-configured assembly, individuals may decorate packages, greeting card envelopes, or objects with a traditional bow and crossed ribbon, but without the time, skill, or tools that previously were required to accomplish an attractive and professional-looking decoration. In addition, individuals may use this pre-configured assembly to bind together groups of packages or objects (such as books).

Currently, an individual desiring to decorate a gift with a traditional bow and crossed ribbon ordinarily must purchase a roll of commercially-available decorative ribbon, measure and cut two lengths of ribbon, one for each direction around the package, and attach the four ends of ribbon together in some way, typically by stapling, taping, or tying the ends together. Then, the individual can either craft a bow from scratch using the rolled ribbon or affix a commercially-available, pre-made bow over the intersection of the four ribbon ends, provided that the pre-made bow matches, or at least aesthetically complements, the ribbon used.

A single length of ribbon may be used, but with functional and aesthetic sacrifices, and with a moderate level of skill and time required to accomplish the task. An individual may place the center of the length of ribbon at the center of the top face of the package, pull each end of the ribbon in opposite directions around opposing side faces and under the bottom face. On the bottom face, the two ends of the ribbon are crossed and folded over each other at a right angle to their original direction of travel, and pulled up over the remaining opposing side faces back to the center of the top face of the package. There, the two ends of the ribbon are tied together in a decorative bow, or may have a pre-made bow placed over the knot that secures the ribbon. Because the ribbon is folded over itself, without any routing apparatus, the ribbon is unattractively pinched and creates a bulky protrusion on the bottom face that prevents the package from sitting flat on hard surfaces. The pinching of the ribbon and the protrusion on the bottom face limits this method to minimal ribbon thicknesses and widths, such as one-quarter inch acetate, and generally is not aesthetically pleasing.

Another method, used primarily in commercial packaging, uses hook and loop pairings attached on opposite ends of the ribbon. With this method, the ribbon must be thick enough to hold the hook and loop pads and the ribbon must be pre-cut to a specific length.

The preferred apparatus, assembly, and method of the present application provides for routing a single length of flexible ribbon or strap around a package in a crossed configuration on two opposing faces, in which the ribbon is adjustable within a wide range of overall package dimensions and sizes.

BRIEF SUMMARY OF THE INVENTION

In various preferred embodiments, the present invention provides an apparatus, assembly, and method to route a single length of flexible ribbon around a package, gift bag, envelope, or object(s), in a crossed configuration at both the top and bottom faces of the item(s) being wrapped or bound. The routing apparatus provides a routing edge to turn a single length of ribbon preferably at a right angle to create two loops of ribbon crossing generally perpendicularly beneath the routing apparatus. As a result of using a single length of ribbon, increasing the length of one loop, by pulling the ribbon across the routing edge, correspondingly decreases the length of the other loop, whereby the ribbon self-adjusts to the dimensions of the package allowing use within a wide range of overall package dimensions and sizes. The preferred assembly of the present invention provides a pre-configured assembly, consisting of a routing apparatus threaded with a length of ribbon routed through and attached/attachable to the routing apparatus, which may include a functional housing, and may have a decorative and/or functional item (such as a decorative bow or dry erase writing surface) affixed to the top of the housing. With this pre-configured assembly, individuals may decorate packages, gift bags, greeting card envelopes, or objects with an attractive crossed ribbon and bow (or functional item), but generally without the time, skill, or tools that previously were required to accomplish an attractive and professional-looking decoration. In addition, individuals may use this pre-configured assembly to securely bind together groups of packages or objects (such as books).

The various preferred embodiments of the invention permit the single length of ribbon to be pulled taut in all four directions that emanate from the routing apparatus regardless of the proportional dimensions of the package(s) or object(s), and within a range of overall ribbon lengths. That is, the same pre-configured assembly is preferably used to wrap a shirt box, a pillow, a picture frame, and a basketball. But tightening the ribbon around the package(s) or object(s) and securing the ribbon is achieved differently in the various preferred embodiments described herein. In some of the preferred embodiments, both ends of the ribbon are attached/attachable to the routing apparatus and the ribbon is tightened around the package by use of an elastic ribbon material.

In some of the preferred embodiments, only one end of the ribbon is attached/attachable to the routing apparatus and the ribbon is tightened around the package by the user pulling the unanchored end through the routing apparatus and sliding into the routing apparatus' housing an apparatus and assembly, which secures the ribbon in the routing apparatus' housing and, in some embodiments, cuts any excess length of ribbon for discarding.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
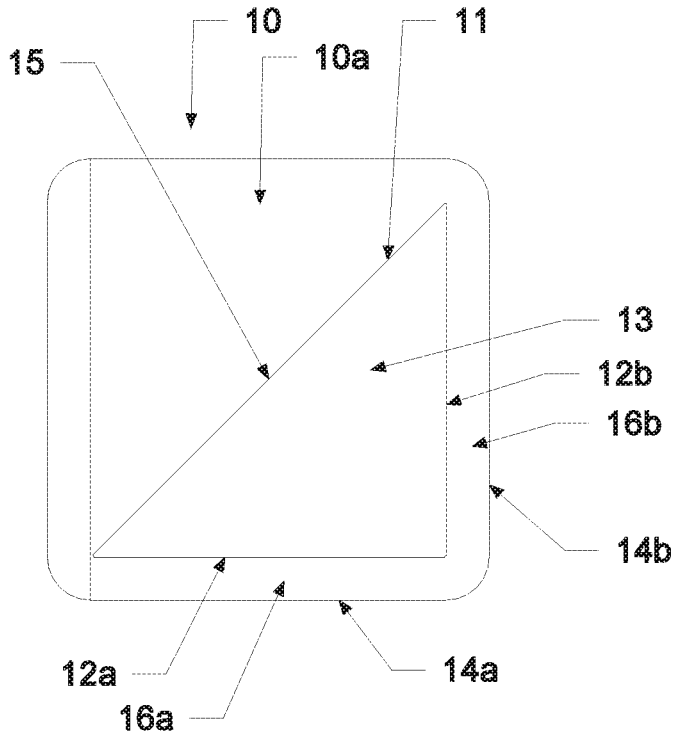
FIG. 1 is a top plan view of a ribbon routing apparatus in accordance with a first preferred embodiment of the present invention.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the device and instruments and related parts thereof. The terminology includes the above-listed words, derivatives thereof and words of similar import.

First Preferred Embodiment

Figure 2:
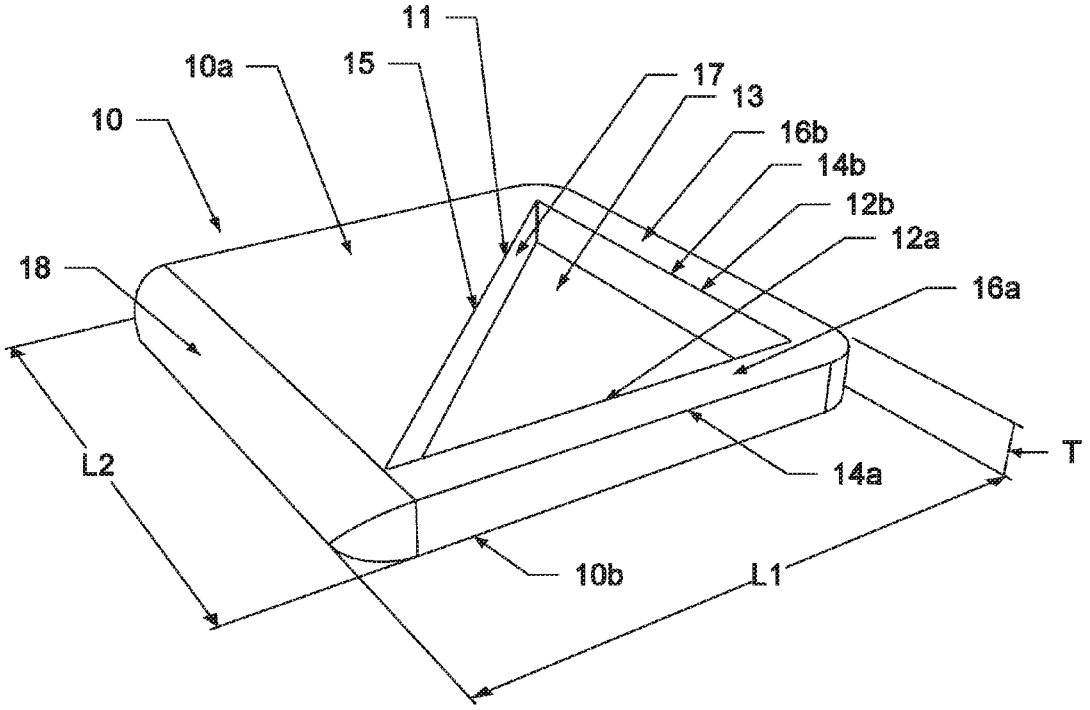
FIG. 2 is a perspective view of the ribbon routing apparatus shown in FIG. 1.
Figure 3:
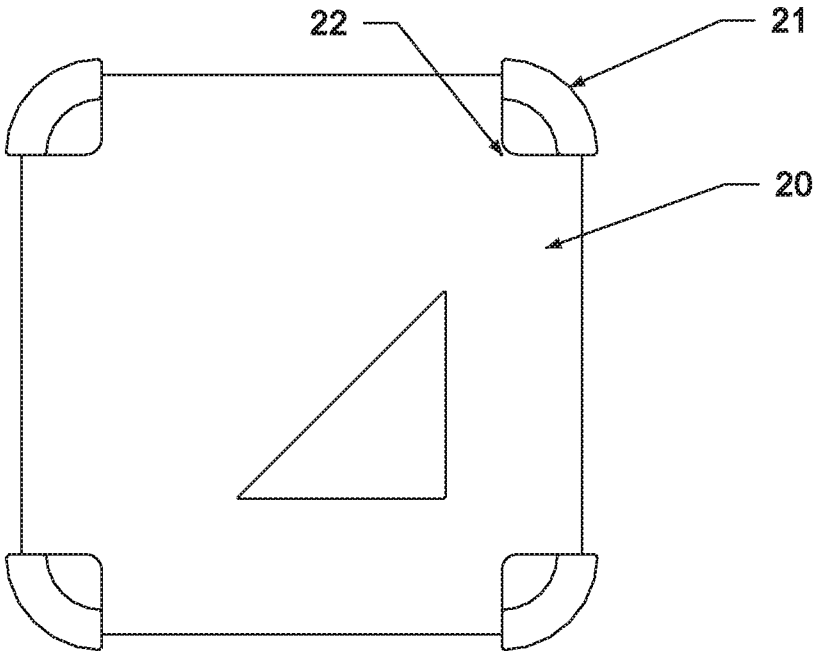
FIG. 3 is a top plan view of the lower piece of the routing apparatus housing, or cup, in accordance with a first preferred embodiment of the present invention.
Figure 4:
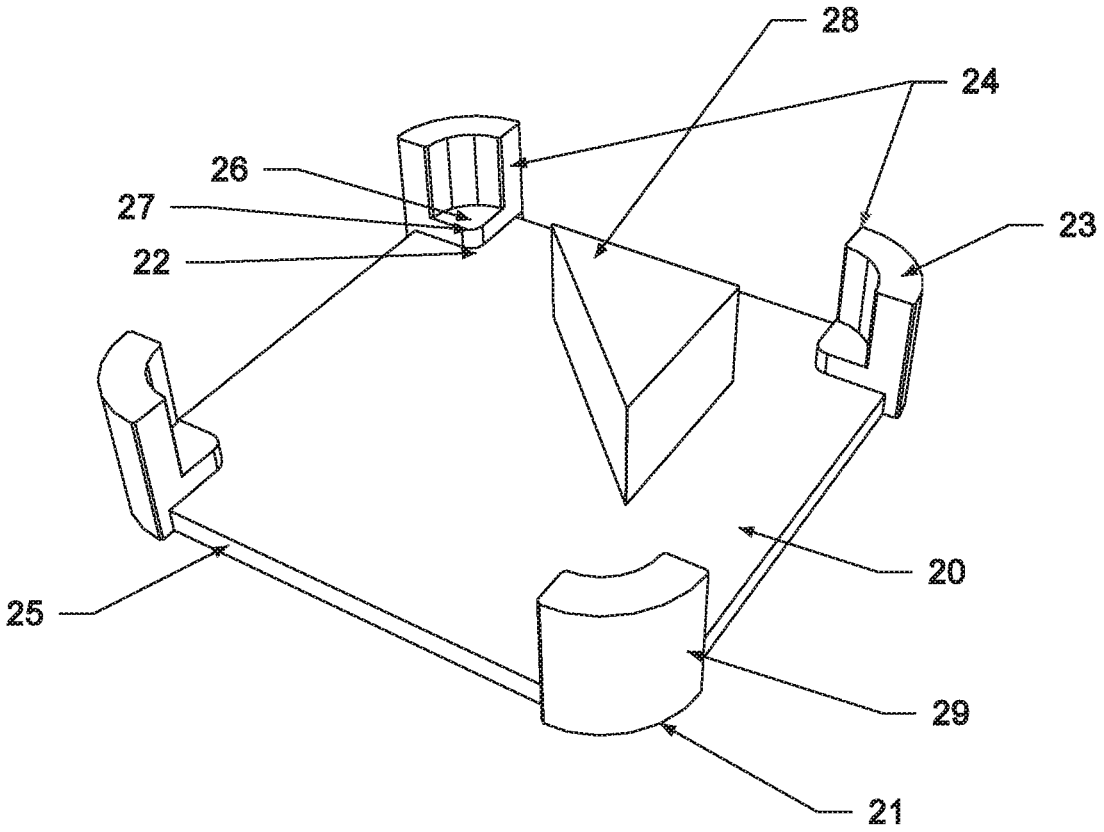
FIG. 4 is a perspective view of the cup shown in FIG. 3.
Figure 5:
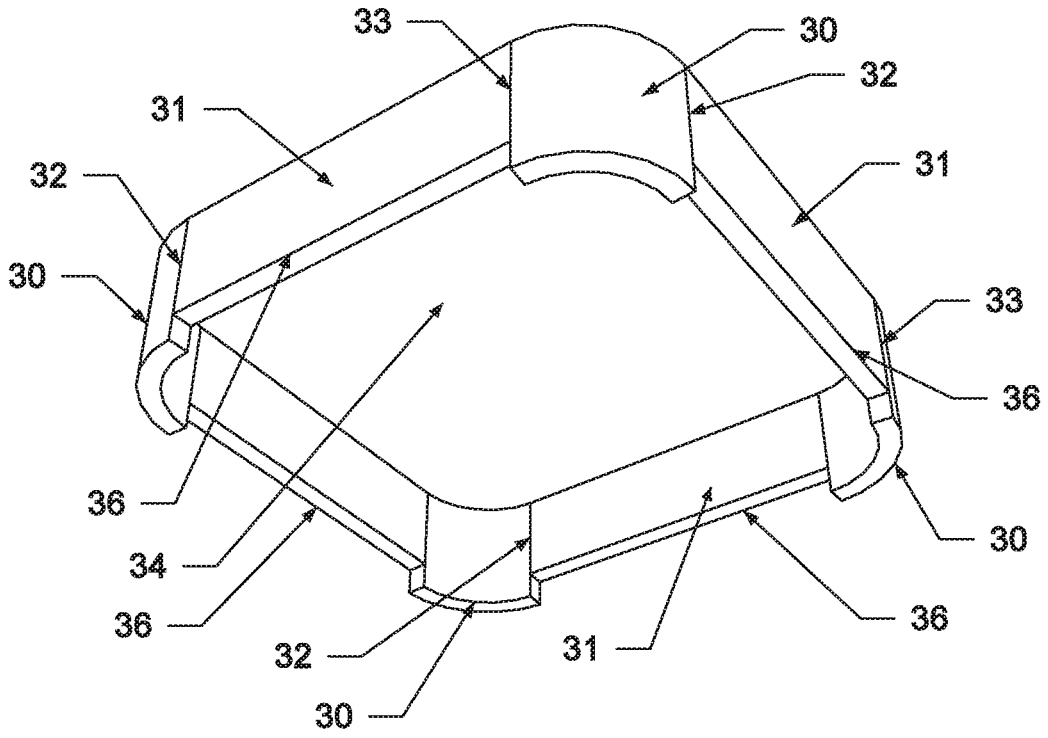
FIG. 5 is a perspective view of the upper piece of the routing apparatus housing, or lid, in accordance with a first preferred embodiment of the present invention.
Figure 6:
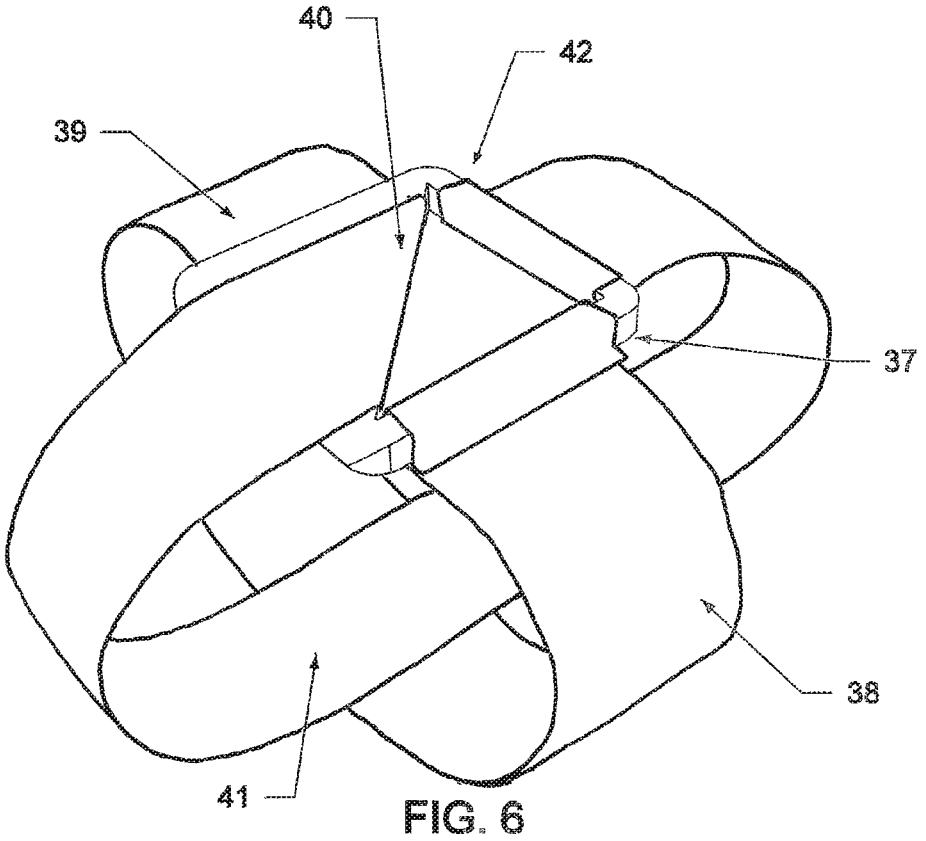
FIG. 6 illustrates a method for routing a ribbon through the routing apparatus shown in FIGS. 1-2 in accordance with a first preferred embodiment of the present invention.
Figure 7:
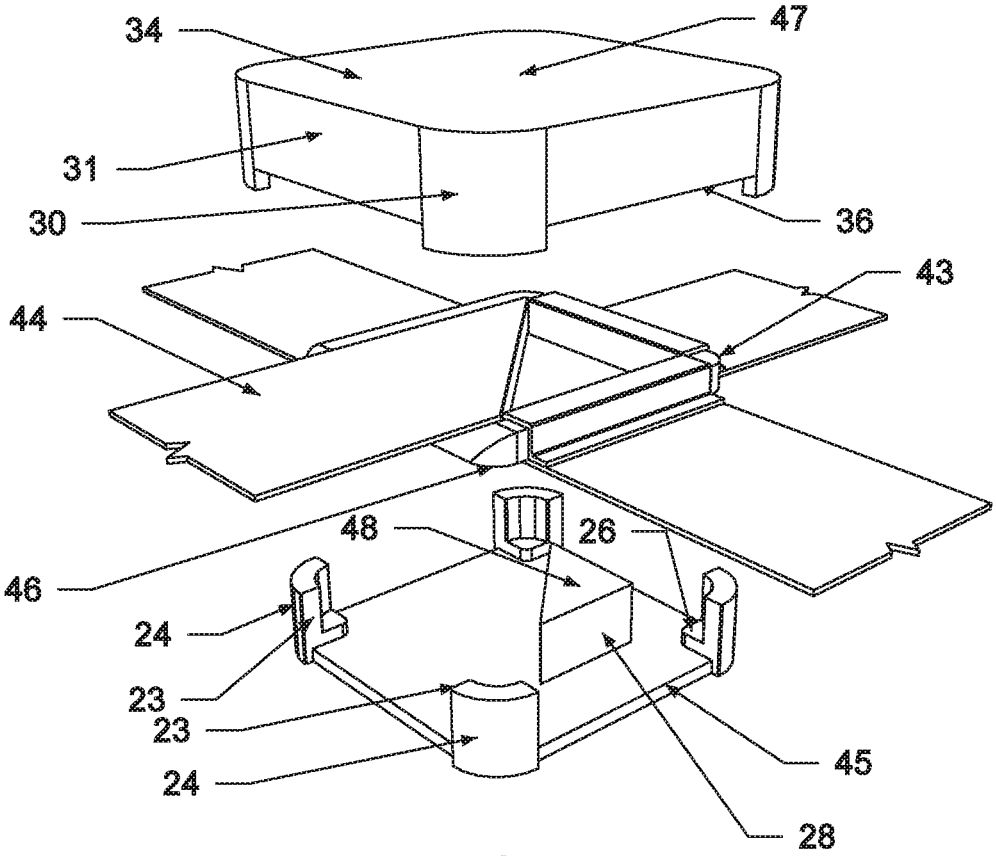
FIG. 7 illustrates the assembly of the routing apparatus, threaded ribbon, and routing apparatus housing in accordance with a first preferred embodiment of the present invention.
Figure 7A:
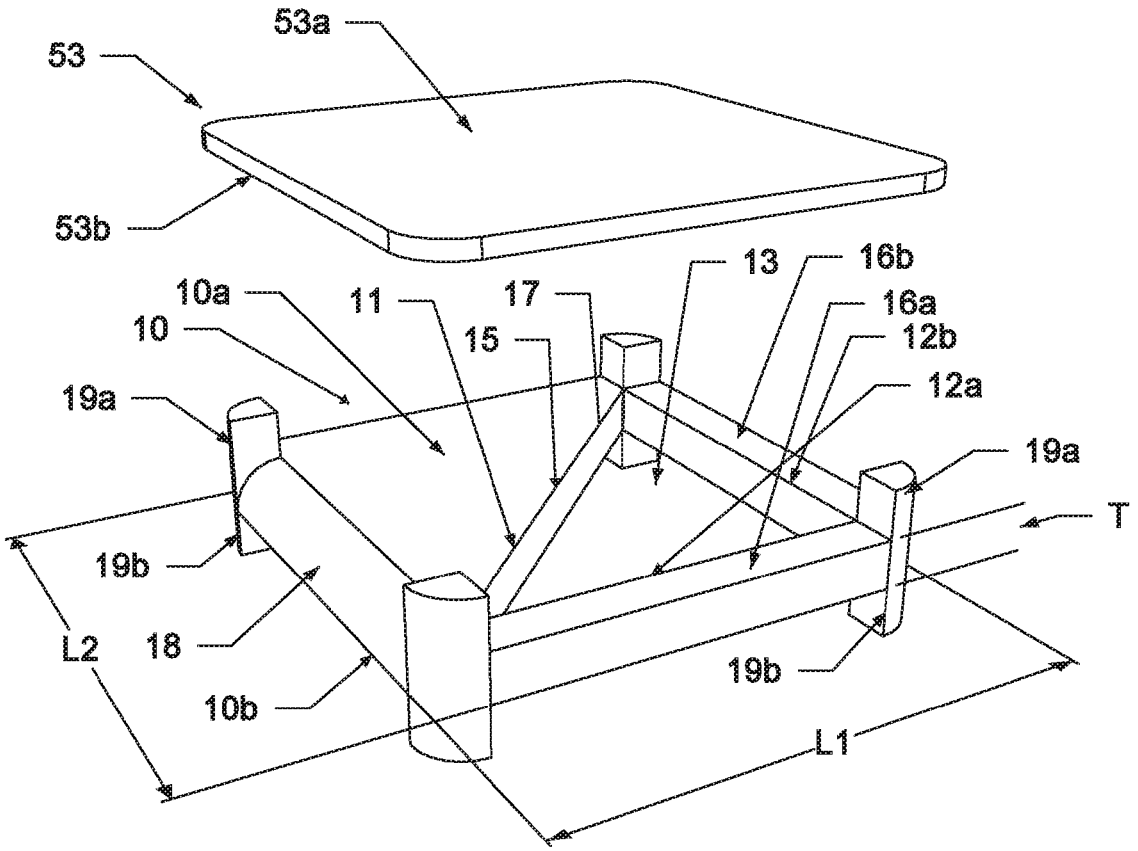
FIG. 7A, is a perspective view of a ribbon routing apparatus and lid in accordance with an alternative first preferred embodiment of the present invention.

Referring to FIGS. 1-8, a first preferred embodiment of the present invention is comprised of a single-piece routing apparatus or body (as shown in FIGS. 1-2), and a two-piece functional housing therefor, comprised of a lower piece of the routing apparatus housing, or "cup" (as shown in FIGS. 3-4), and an upper piece of the routing apparatus housing, or "lid" (as shown in FIG. 5). As shown in FIG. 6, a single length of elastic ribbon is routed through, and both ends are attached to, the routing apparatus. As shown in FIG. 7, the routing apparatus, threaded with the ribbon, is combined with the cup and lid to function as an assembly, and a decorative and/or functional item is attached to the top of the lid. As shown in FIG. 7A, an alternative first preferred embodiment is comprised of a body and lid, with a single length of elastic ribbon routed through, and both ends attached to the routing apparatus. Each of these preferred embodiments is used to decorate and/or secure a package or object, or a group thereof, as provided for in FIG. 8. The ribbon may be routed around and secured to nearly any object or package for decorative purposes, for securing objects for carrying or for nearly any reason that an object or objects would be wrapped with a ribbon or strap. However, the preferred system is generally provided to wrap a decorative ribbon around a package for decorative purposes.

FIG. 1 shows a top plan view of a ribbon routing apparatus in accordance with a first preferred embodiment of the present invention, which preferably is formed from a single piece of material substantially in the shape shown. Specifically, the routing apparatus or body 10 is substantially in the shape of a square, but is not so limited and may have nearly any shape and/or size that is appropriate for the design of the specific ribbon routing apparatus. From the body 10, a right isosceles triangle 11 is preferably formed such that the short sides 12*a*, 12*b* slightly exceed the width of the ribbon. The preferred right isosceles triangle 11 is removed, thereby leaving a void 13. The void 13 is preferably triangular, but is not so limited and may have nearly any size and/or shape that accommodates routing of the ribbon therethrough. The void 13 is preferably positioned within the body 10 so that the sides 12*a*, 12*b* forming the right angle are set in from the corresponding outer sides 14*a*,14*b* of the body 10, and the hypotenuse 15 of the triangular void 13 transverses the body 10 at a forty-five degree (45°) diagonal angle relative to the outer sides 14*a*, 14*b* of the body 10. The hypotenuse 15 is not limited to being positioned at the preferred forty-five degree (45°) angle relative to the sides 12*a*, 12*b* and may be positioned at nearly any angle, such as an acute angle less than forty-five degrees (45°), permitting routing of the ribbon around an object, such as a package, at angles other than ninety degrees (90°) or such that the ribbon is wrapped around a greater surface area of the object than that shown in the preferred embodiments herein.

As shown in FIG. 2, the result is two strips or legs 16*a*, 16*b* of material remaining on two adjacent sides of the outer square 10, preferably resembling square rods joined at a right angle, and an inner face 17 formed by the hypotenuse 15 of the triangular void 13. All edges of the routing apparatus over which the ribbon travels or rests or comes into close proximity (as shown in FIG. 6) are slightly rounded to avoid snagging the ribbon (for clarity, the slight rounding of the edges is not shown). The inner face 17 formed by the hypotenuse 15 of the triangular void 13 is substantially rounded, up to a full half-round, to facilitate sliding of the ribbon over the surface (for clarity, this rounding is not shown). One outward face 18 of the body 10 is a full quarter round from the top face 10*a* to the bottom face 10*b* to facilitate sliding of the ribbon over the surface.

The legs preferably include a first leg 16*a* and a second leg 16*b* that are positioned at two sides of the void 13. The first and second legs 16*a*, 16*b* preferably define first and second acute angles relative to the hypotenuse or routing edge 15. The first and second angles are preferably forty-five degrees (45°) such that the void has its preferred right isosceles triangular-shape, but is not so limited to such shape. The body 10 has a first surface 10*a* and a second surface 10*b* that define a thickness T therebetween. The first leg 16*a* also preferably defines a first length $L_1$ and the second leg 16*b* preferably defines a second length $L_2$. The first and second lengths $L_1$, $L_2$ are greater than the thickness T.

FIG. 3 shows a top plan view of the lower piece, or "cup," of the routing apparatus housing in accordance with a first preferred embodiment of the present invention, which is formed substantially in the shape shown. The cup's base 20 is substantially a square that is larger than the outside square of the routing apparatus (shown in FIGS. 1-2). Each corner of the cup's base is given a quarter round 21 with a radius beginning at a point 22 where the edges of the ribbon would intersect if crossed over the center of the cup's base.

As shown in FIG. 4, along and following the rounded corners 21 of the cup's base 20, walls 23 are raised upward perpendicularly to the cup's base 20. All edges of the four walls are slightly rounded over (for clarity, this rounding is not shown) to avoid snagging the ribbon as it slides between the ends 24 of the curved walls 23. In between the ends 24 of the curved walls 23, each side 25 of the cup's base is inset toward the center of the cup's base to create a void slightly wider than the ribbon in which the ribbon will travel and/or rest. Four flat-topped surfaces 26 are slightly raised up from the cup's base 20 within the inner radius 22 of the curved walls 23. The radius point 22 of each of these raised surfaces 26 is slightly rounded 27 to avoid snagging the ribbon as it travels through the cup. A flat-topped triangular surface 28 is raised up from the cup's base 20 to the same height as the curved walls 23.

FIG. 5 is a perspective view of the underside of the upper piece, or lid, of the routing apparatus housing in accordance with a first preferred embodiment of the present invention. The lid is formed from a single piece of material substantially in the shape shown. The lid consists of curved vertical walls 30 that wrap around the outside faces 29 of the curved walls 23 of the cup (shown in FIG. 4), slightly offset outward to permit the lid to slide down over the cup's curved walls 23 (shown in FIG. 4), with straight walls 31 between the curvature points 32, 33. A thin, flat surface 34 is formed atop the lid's curved walls 30 and straight walls 31. From the bottom of each of the lid's straight walls 31, there is a void 36, slightly exceeding the thickness and width of the ribbon, in which the ribbon will rest and/or travel. The edges of these voids are slightly rounded to avoid snagging the ribbon as it travels over the edges (for clarity this rounding is not shown).

FIG. 6 illustrates a method for routing a ribbon through the routing apparatus shown in FIGS. 1-2 in accordance with a first preferred embodiment of the present invention. At step 37, the first end of a single length of elastic ribbon is attached to the first leg of the routing apparatus by looping the ribbon around the bar from the bottom and attaching the ribbon on top of itself by stapling, sewing, riveting, etc. At step 38, the other end of the ribbon is then routed down into space and back up to the opposite side of the routing apparatus to create a loop beneath the routing apparatus. At step 39, the second end of the ribbon is threaded under the bottom face of the routing apparatus. At step 40, the ribbon is threaded up through the triangular void in the routing apparatus, and is folded over the hypotenuse of the triangular void to the top side of the routing apparatus, turning the ribbon substantially at a right angle from its initial direction of travel. At step 41, once the ribbon is turned at a right angle, the ribbon is then threaded from the top side of the routing apparatus down into space, crossing the first loop of ribbon substantially perpendicularly, and back up to the opposite side of the routing apparatus. At step 42, the second end of the elastic ribbon is then secured to the second leg of the routing apparatus by looping the ribbon around the second leg from the bottom and attaching the ribbon to itself by stapling, sewing, riveting, etc. As a result, the ribbon emanates in four directions from the routing apparatus, with each direction of ribbon being substantially centered on, and traveling substantially perpendicular to, each side of the outer square of the routing apparatus.

Figure 34:
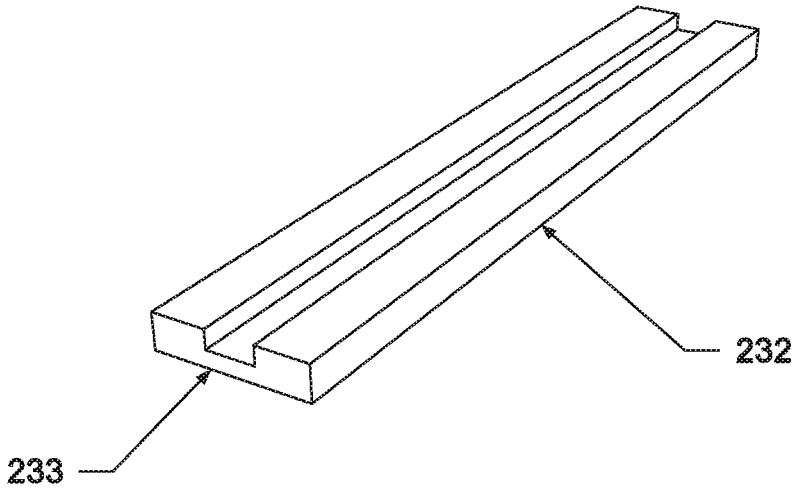
FIG. 34 is a perspective view of a lower plate of an apparatus and assembly to attach and detach a ribbon to the routing apparatus housing in accordance with a fourth preferred embodiment of the present invention.
Figure 35:
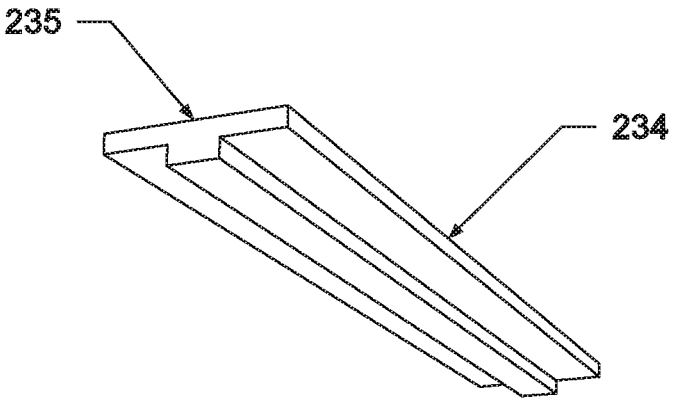
FIG. 35 is a perspective view of an upper plate of an apparatus and assembly to attach and detach a ribbon to the routing apparatus housing in accordance with a fourth preferred embodiment of the present invention.
Figure 36:
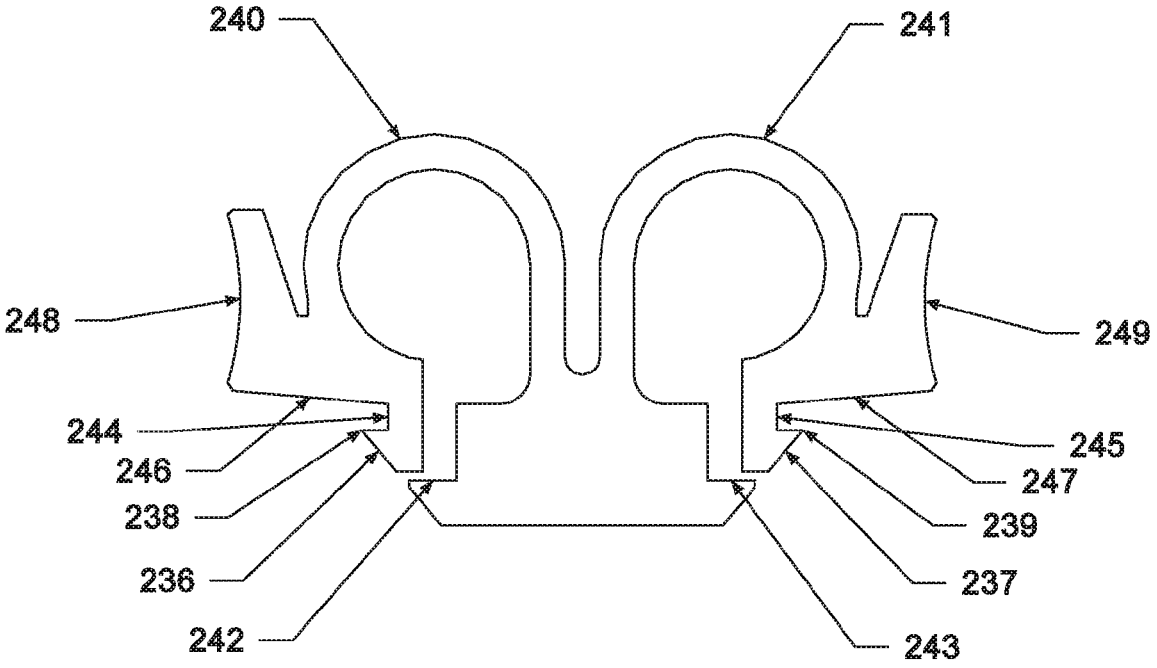
FIG. 36 is a top plan view of a locking apparatus to function within an assembly to attach and detach a ribbon to the routing apparatus housing in accordance with a fourth preferred embodiment of the present invention.

As an alternative to attaching the ribbon to the routing apparatus at the legs of the triangular void, one or both ends of the ribbon may be attached to a detachable apparatus positioned outside one or both legs of the triangular void, as shown in FIGS. 34-36.

After the routing apparatus has been threaded with the ribbon as shown in FIG. 6, FIG. 7 illustrates the assembly of the routing apparatus, threaded ribbon, and routing apparatus housing in accordance with a first preferred embodiment of the present invention. First, the routing apparatus 43 and threaded ribbon 44 (for clarity, the segments of ribbon emanating from the routing apparatus are shown truncated) are placed into the cup 45, such that the four segments of ribbon 44 emanating from the center of the routing apparatus 43 rest between the ends 23 of the curved walls 24 of the cup 45, and the corners 46 of the outer square of the routing apparatus' 43 bottom face rest on the raised surfaces 26 inside the cup's curved walls 24. Elevating the routing apparatus within the cup promotes sliding of the ribbon for adjustment and prevents the downward pressure that is created by tightening of the ribbon as it travels over the top face of the routing apparatus 43 from pressing down on, and inhibiting the corresponding travel of, the ribbon routed under the bottom face of the routing apparatus 43. Second, the lid 47 is lowered over and around the cup 45, such that the ribbon passing between the ends 23 of the cup's curved walls 24 passes through the voids 36 in the bottom of the lid's straight walls 31. The surfaces above these voids 36 hold the ribbon flat against the face of the package or object being wrapped. The bottom face (not shown) of the lid's 47 top surface 34 is attached to the top face 48 of the cup's raised triangular surface 28. Alternatively or in addition, the outer faces of the cup's curved walls 24 may be attached to the inner faces of the lid's curved walls 30.

A decorative and/or functional item preferably is attached to the top face of the lid's 47 top surface 34, such as a decorative bow (made from the elastic ribbon material or a non-elastic ribbon material that matches or complements the elastic ribbon material), a writing surface, a box of crayons, silk flowers, a music box, a box of chocolates, etc.

To further minimize the appearance of the routing apparatus housing when placed on the package or object to be wrapped, the material forming the components preferably is colored to match or complement the dominant color of the ribbon used.

FIG. 7A shows an alternative first preferred embodiment of the present invention, comprised of a body 10 and a lid 53. Specifically, the body is as shown in FIGS. 1-2, with the addition of four vertical posts 19 at the corners of the body, which extend upward 19*a* from the top face 10*a* and downward 19*b* from the bottom face 10*b* of the body 10. The distances from the top face 10*a* of the body 10 to the top faces of the upper posts 19*a*, and the distances from the bottom face 10*b* of the body 10 to the bottom faces of the lower posts 19*b*, slightly exceed the thickness of the ribbon. When the ribbon is routed and attached to the body, as shown in FIG. 6, the downward-extending posts 19*b* level the body on the top face of the package, and the upward-extending posts 19*a* create a platform for the lid 53.

In this alternative first preferred embodiment, the lid 53 is composed of a single piece of rigid flat stock, preferably in a shape corresponding to the footprint of the body 10, but is not so limited and may have nearly any shape and/or size that is appropriate for the design of the specific ribbon routing apparatus. The bottom face 53*b* of the lid 53 preferably is attached to the top faces of the upward-extending 19*a* posts 19 of the body 10. A decorative and/or functional item preferably is attached to the top face of the lid 53*a*. A single length of elastic ribbon preferably is routed through and attached to the routing apparatus as illustrated in, and described in relation to, FIG. 6. All edges of the routing apparatus over which the ribbon travels or rests or comes into close proximity (as shown in FIG. 6) are slightly rounded to avoid snagging the ribbon (for clarity, the slight rounding of the edges is not shown). The lid in this alternative first preferred embodiment holds the ribbon passing over the top face 10*a* of the body in place, and assists in identifying and maintaining the preferred orientation of the assembly and ribbon when used as provided for in FIG. 8.

Figure 8:
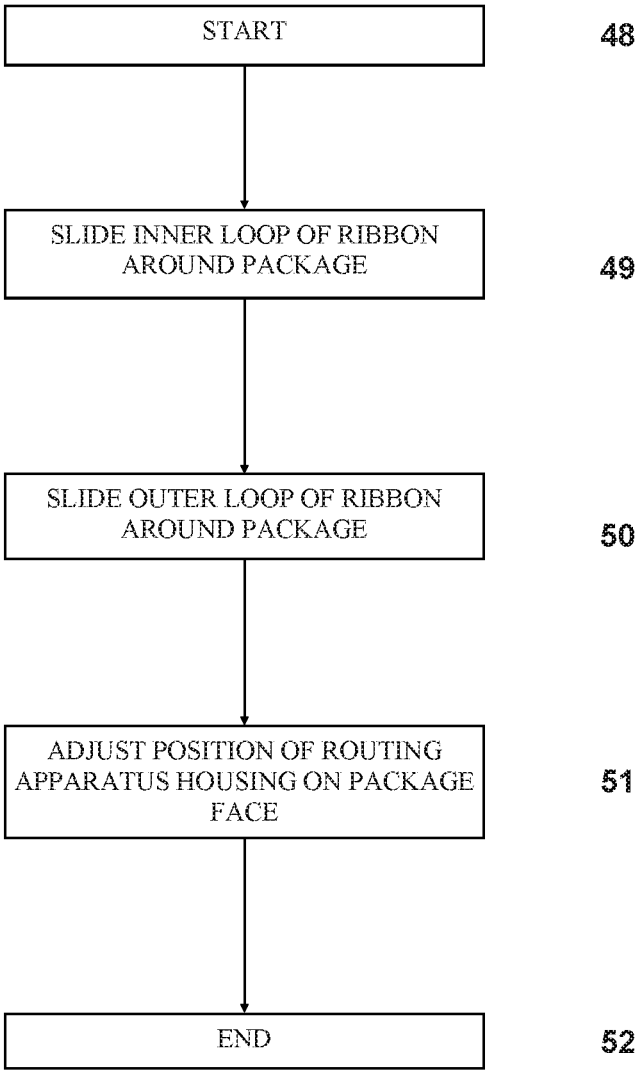
FIG. 8 provides a method flowchart for using the assembly in accordance with a first and second preferred embodiment of the present invention.

FIG. 8 provides a method flowchart for using the assembly in accordance with a first and second preferred embodiment of the present invention. The process starts at block 48. At block 49, the user slides the inner loop of ribbon around the package or object being wrapped to create a single direction of ribbon encircling the package. At block 50, the user slides the outer loop of ribbon around the package to create a second direction of ribbon encircling the package substantially perpendicular to the inner loop. As the outer loop of ribbon is pulled for sliding around the package, the ribbon slides across the routing edge, pulling the first loop of ribbon taut around the package. The elastic ribbon used in this first preferred embodiment of the present invention tends to level the linear tension around the package by sliding across the routing edge, self-adjusting the ribbon tension throughout both loops of the ribbon when at rest. At block 51, the user adjusts the position of the routing apparatus housing on one face of the package, and adjusts the position of the ribbon on all faces of the package. The process then ends at block 52.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

Second Preferred Embodiment

Figure 9:
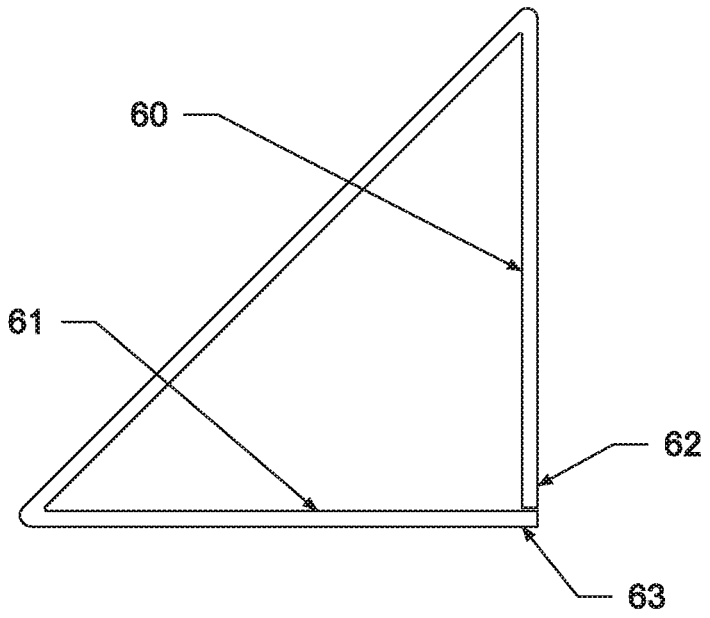
FIG. 9 is a top plan view of a ribbon routing apparatus in accordance with a second preferred embodiment of the present invention.
Figure 10:
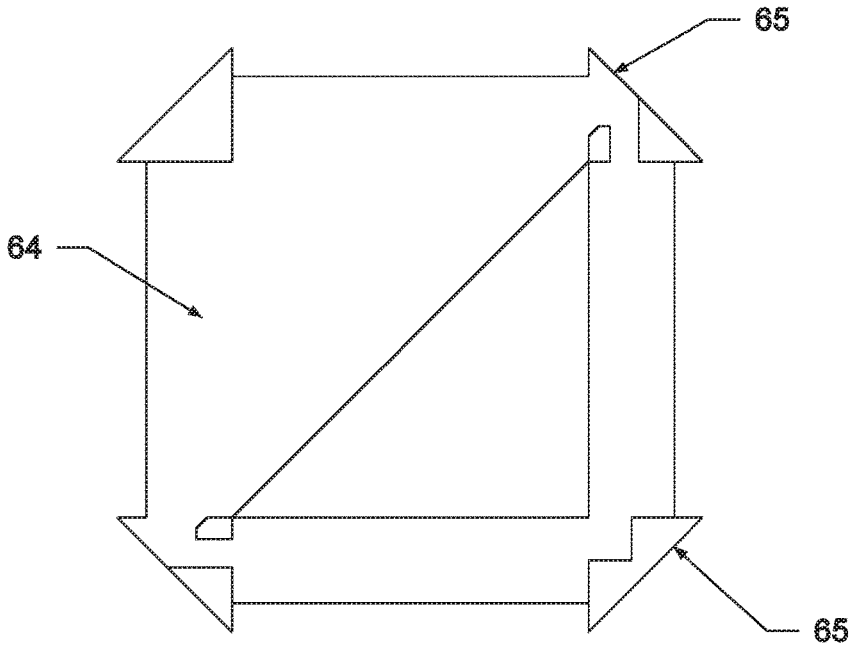
FIG. 10 is a top plan view of the lower piece of the routing apparatus housing in accordance with a second preferred embodiment of the present invention.
Figure 11:
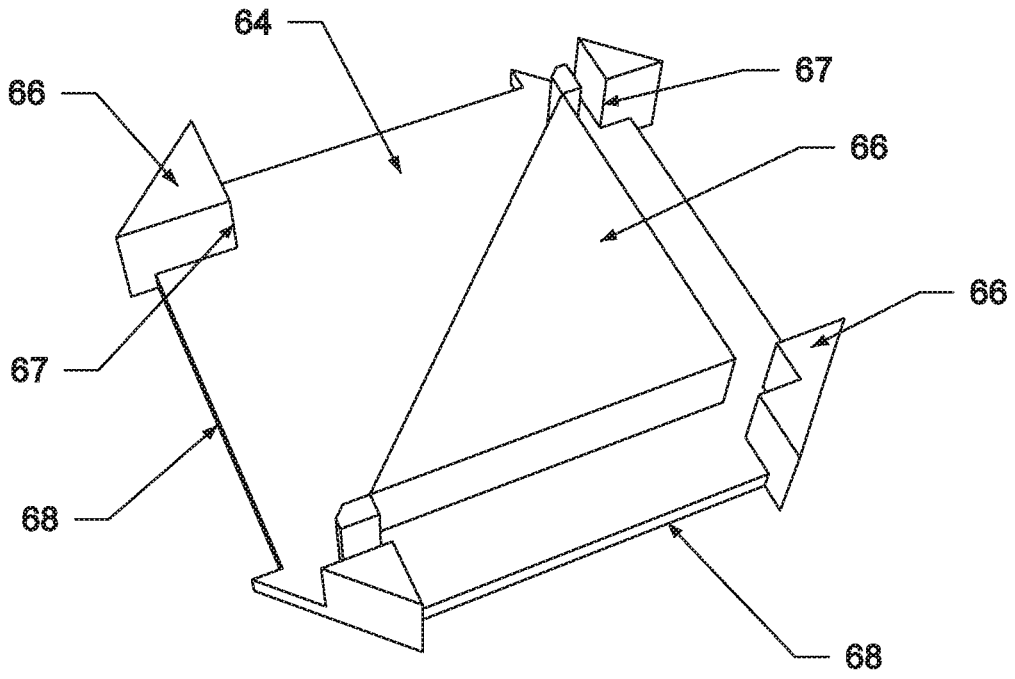
FIG. 11 is a perspective view of the lower piece of the routing apparatus housing shown in FIG. 11.
Figure 12:
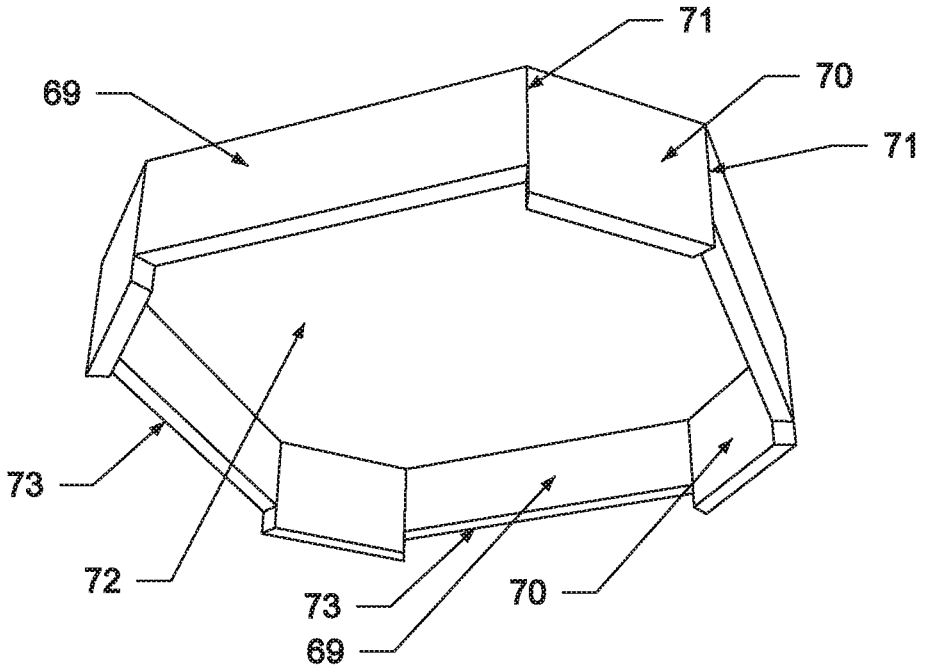
FIG. 12 is a perspective view of the upper piece of the routing apparatus housing in accordance with a second preferred embodiment of the present invention.
Figure 13:
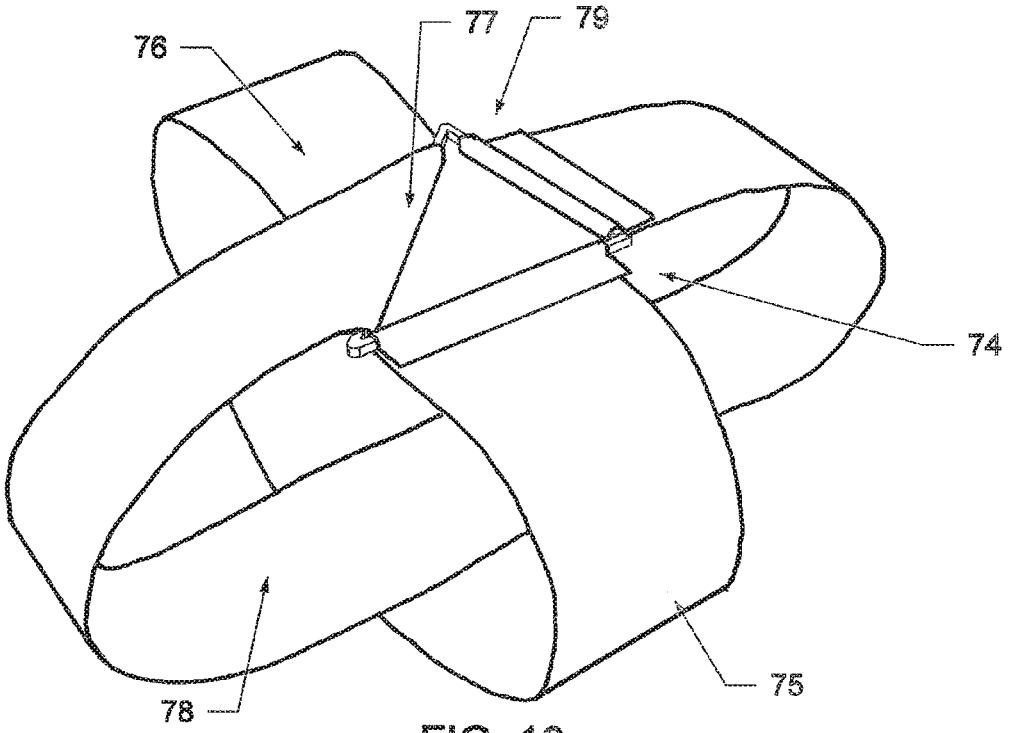
FIG. 13 illustrates a method for routing a ribbon through the routing apparatus in accordance with a second preferred embodiment of the present invention.
Figure 14:
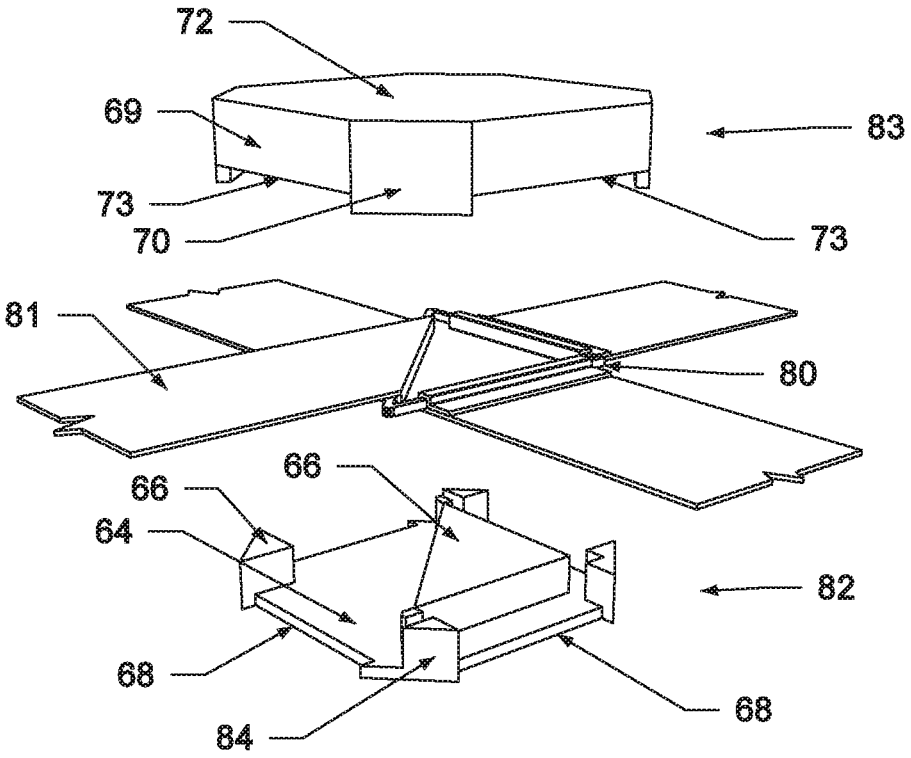
FIG. 14 illustrates the assembly of the routing apparatus, threaded ribbon, and routing apparatus housing in accordance with a second preferred embodiment of the present invention.

Referring to FIGS. 9-14, a second preferred embodiment of the present invention is comprised of a single-piece routing apparatus (as shown in FIG. 9), and a two-piece functional housing therefor, comprised of a lower piece of the routing apparatus housing, or "cup" (as shown in FIGS. 10-11), and an upper piece of the routing apparatus housing, or "lid" (as shown in FIG. 12). As shown in FIG. 13, a single length of elastic ribbon is routed through, and both ends are attached to, the routing apparatus. As shown in FIG. 14, the routing apparatus, threaded with the ribbon, is combined with the cup and lid to function as an assembly, and a decorative and/or functional item is attached to the top of the lid. This assembly is used to decorate and/or secure a package or object, or a group thereof, as provided for in FIG. 8.

FIG. 9 shows a top plan view of a ribbon routing apparatus in accordance with a second preferred embodiment of the present invention, which is formed from a single piece of round wire substantially in the shape of a right isosceles triangle with legs lengths 60, 61 that slightly exceed the width of the elastic ribbon used. The two ends 62, 63 of the single piece of wire meet at the right angle of the triangle.

FIG. 10 shows a top plan view of the cup in accordance with a second preferred embodiment of the present invention, which is formed substantially in the shape shown. Each corner of the cup's base 64 is given a quarter round or (45°) diagonal angle relative to the outer sides of the body 65 (as shown).

As shown in FIG. 11, flat surfaces 66 substantially in the shapes shown are raised upward perpendicularly to the cup's base 64 to hold the routing apparatus in place and direct the ribbon's travel without pinching or snagging. All vertical edges 67 of the raised surfaces are slightly rounded over to avoid snagging the ribbon (for clarity, this slight rounding is not shown). Each outer long side of the cup's base 64 is inset toward the center of the cup's base to create a void 68 slightly wider than the ribbon in which the ribbon will travel and/or rest. All edges of these voids are rounded over to avoid snagging the ribbon (for clarity, this rounding is not shown).

FIG. 12 is a perspective view of the upper piece, or lid, of the routing apparatus housing in accordance with a second preferred embodiment of the present invention, which is substantially in the shape shown. The lid consists of straight 69 and angled 70 (or curved in the alternative form) vertical walls that wrap around the outside faces of the cup's base 64 (shown in FIGS. 10-11). These walls 69, 70 are slightly offset outward to permit the lid to slide down over the cup's raised shapes 66 (shown in FIGS. 10-11), with straight walls 69 between the angled corners 71. A thin, flat surface 72 is formed atop the lid's walls 69, 70. From the bottom of each of the lid's walls 69, 70, there is a void 73, slightly exceeding the thickness and width of the ribbon, in which the ribbon will rest and/or travel.

FIG. 13 illustrates a method for routing a ribbon through the routing apparatus shown in FIG. 9 in accordance with a second preferred embodiment of the present invention. At step 74, the first end of a single length of elastic ribbon is attached to the first leg of the routing apparatus by looping the ribbon around the bar from the bottom and attaching the ribbon on top of itself by stapling, sewing, riveting, etc. At step 75, the other end of the ribbon is then routed down into space and back up to the opposite side of the routing apparatus to create a loop beneath the routing apparatus. At step 76, the loose end of the ribbon is threaded under the bottom face of the routing apparatus. At step 77, the ribbon is threaded up through the triangular void in the routing apparatus, and is folded over the hypotenuse of the triangular void to the top side of the routing apparatus, turning the ribbon substantially at a right angle from its initial direction of travel. At step 78, once the ribbon is turned at a right angle, the ribbon is then threaded from the top side of the routing apparatus down into space, crossing the first loop of ribbon substantially perpendicularly, and back up to the opposite side of the routing apparatus. At step 79, the second end of the elastic ribbon is then secured to the second leg of the routing apparatus by looping the ribbon around the bar from the bottom and attaching the ribbon to itself by stapling, sewing, riveting, etc. As a result, the ribbon emanates in four directions from the routing apparatus, with each direction of ribbon being substantially centered on, and traveling substantially perpendicular to, each side of the outer square of the routing apparatus.

As shown in FIG. 14, after the routing apparatus 80 has been threaded with the ribbon 81 (as illustrated in FIG. 13), the routing apparatus 80 and threaded ribbon 81 are placed into the cup 82, such that the four segments of ribbon 81 emanating from the center of the routing apparatus 80 rest between the voids 68 in the cup's base 64. The lid 83 is lowered over and around the cup 82, such that the ribbon 81 resting in the voids 68 of the cup's base 64 passes through the voids 73 at the bottom of the lid's straight walls 69. The surfaces above these voids 73 hold the ribbon 81 flat against the face of the package or object being wrapped. The bottom face of the lid's top surface 72 is attached to the top faces of the cup's raised shapes 66. Alternatively or in addition, the outer faces 84 of the cup's raised shapes preferably are attached to the inner faces of the lid's angled walls 70.

A decorative and/or functional item preferably is attached to the top face of the lid's 83 top surface 72.

To further minimize the appearance of the routing apparatus housing when placed on the package or object to be wrapped, the material forming the components (except for the wire routing apparatus) preferably is colored to match or complement the dominant color of the ribbon used.

This second preferred embodiment of an assembly is used as provided for in FIG. 8.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

Third Preferred Embodiment

Figure 15:
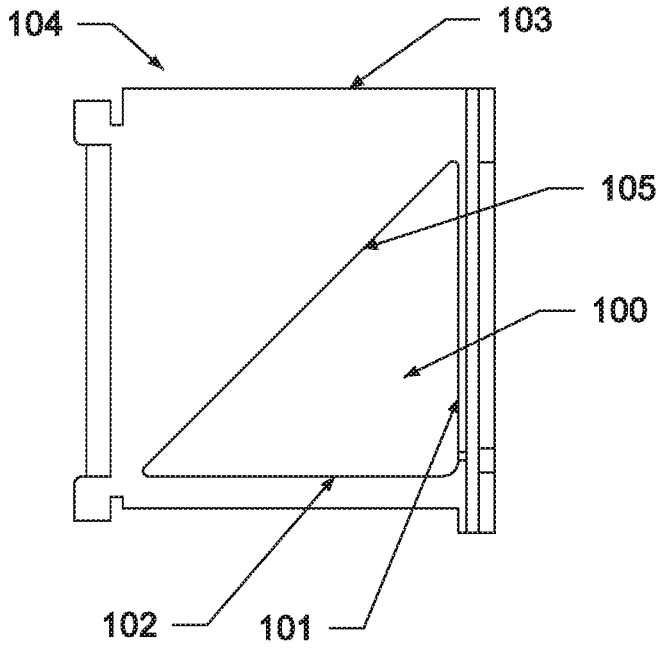
FIG. 15 is a top plan view of a ribbon routing apparatus in accordance with a third preferred embodiment of the present invention.
Figure 16:
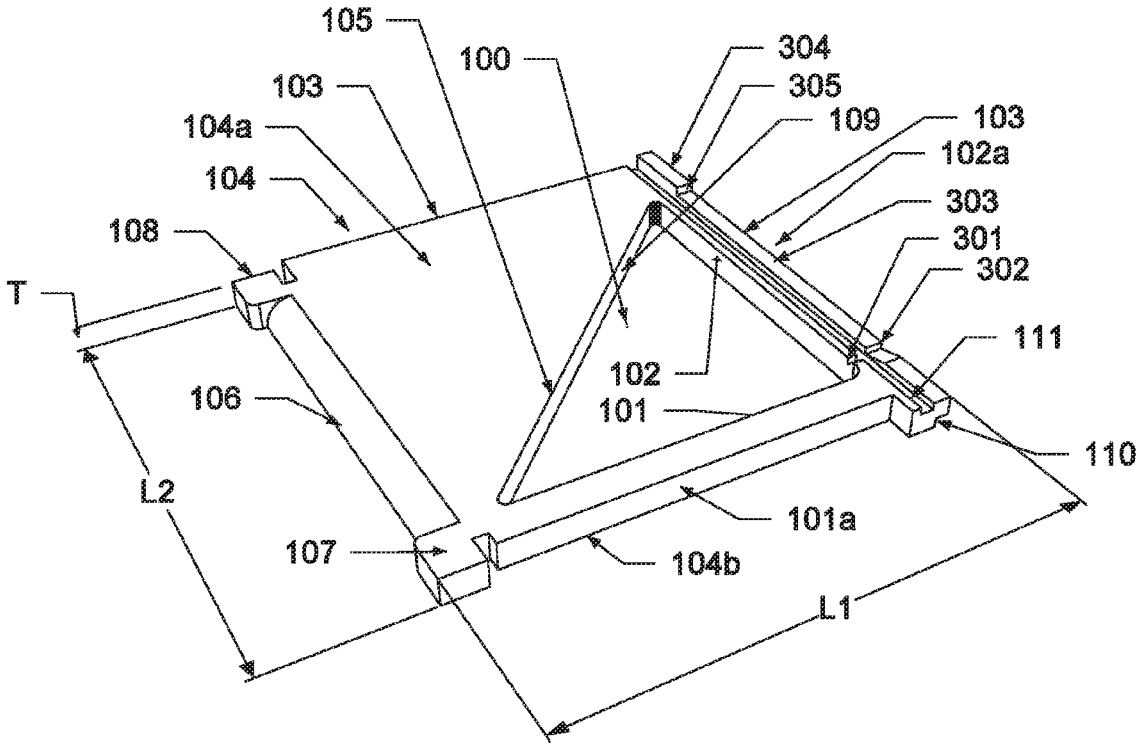
FIG. 16 is a perspective view of the ribbon routing apparatus shown in FIG. 15.
Figure 17:
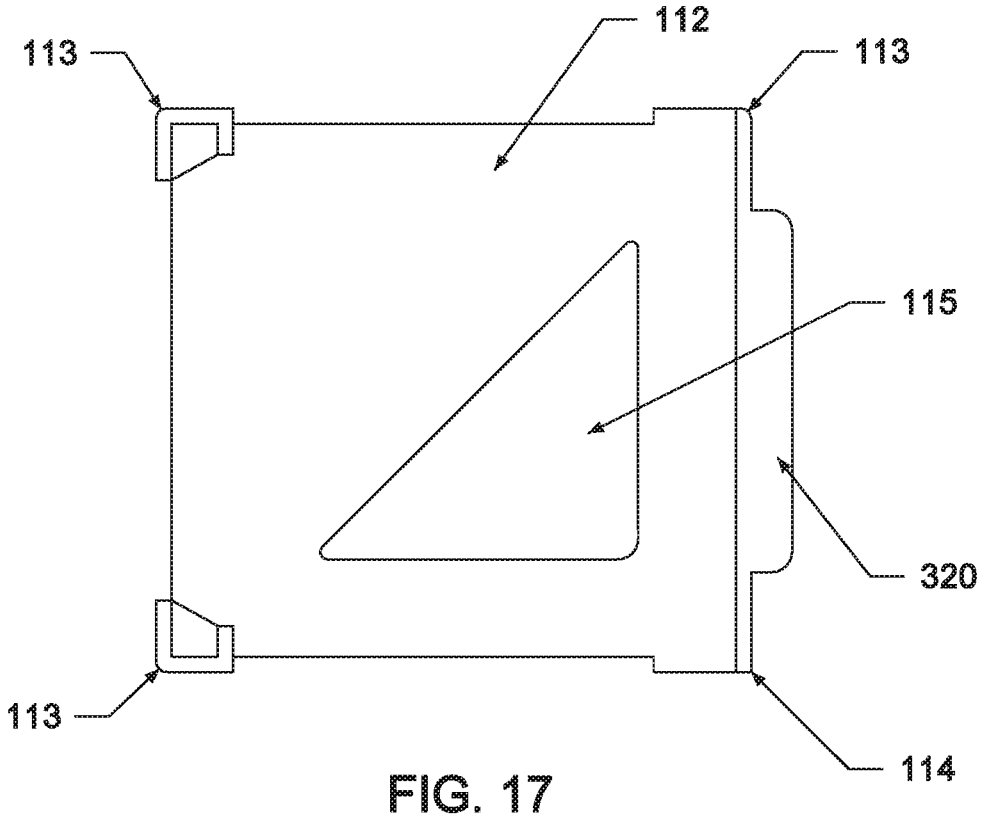
FIG. 17 is a top plan view of the lower piece of the routing apparatus housing in accordance with a third preferred embodiment of the present invention.
Figure 18:
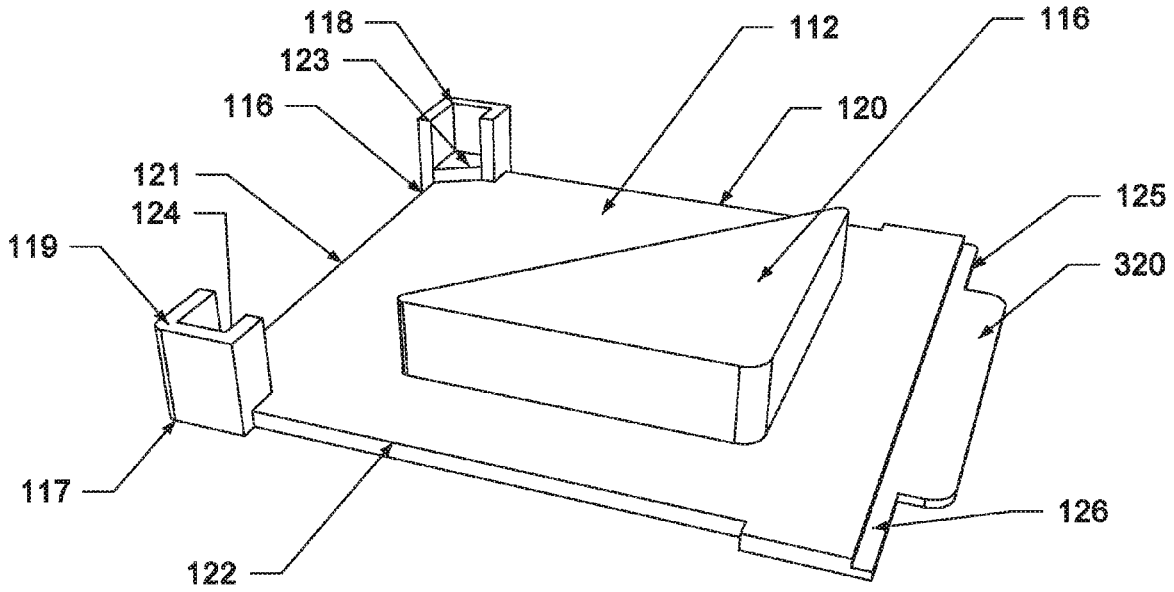
FIG. 18 is a perspective view of the lower piece of the routing apparatus housing shown in FIG. 17.
Figure 19:
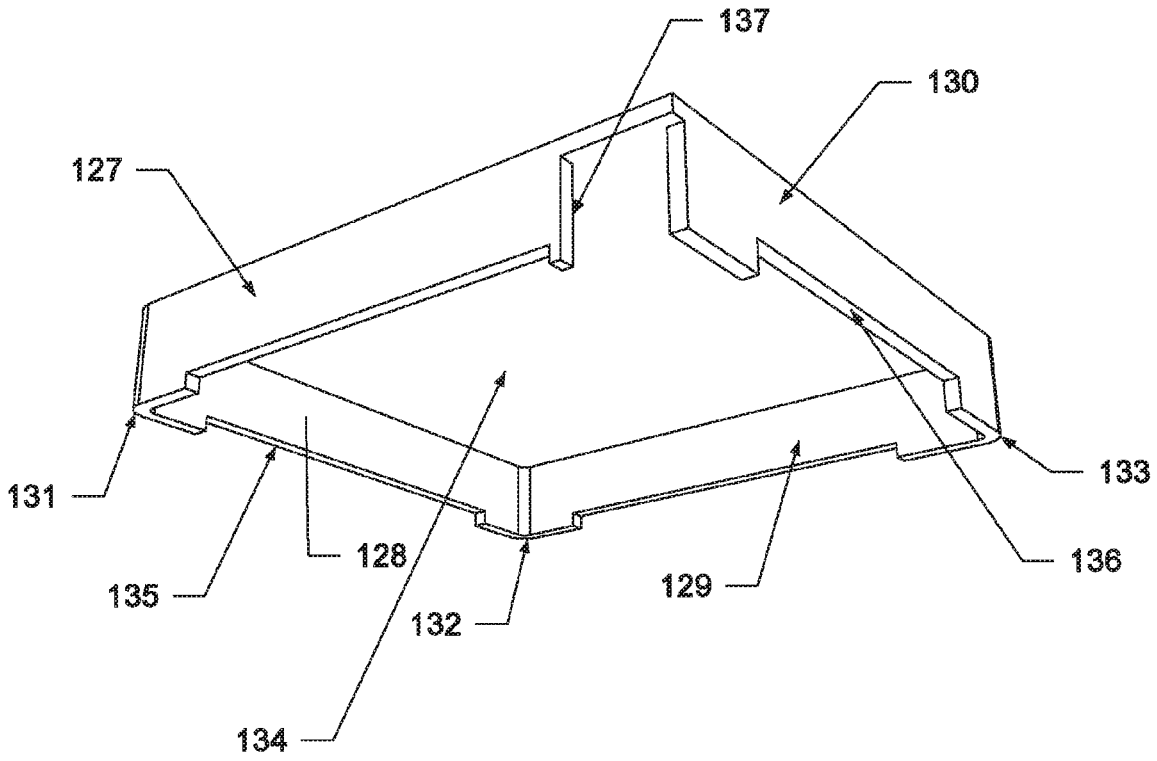
FIG. 19 is a perspective view of the upper piece of the routing apparatus housing in accordance with a third preferred embodiment of the present invention.
Figure 23:
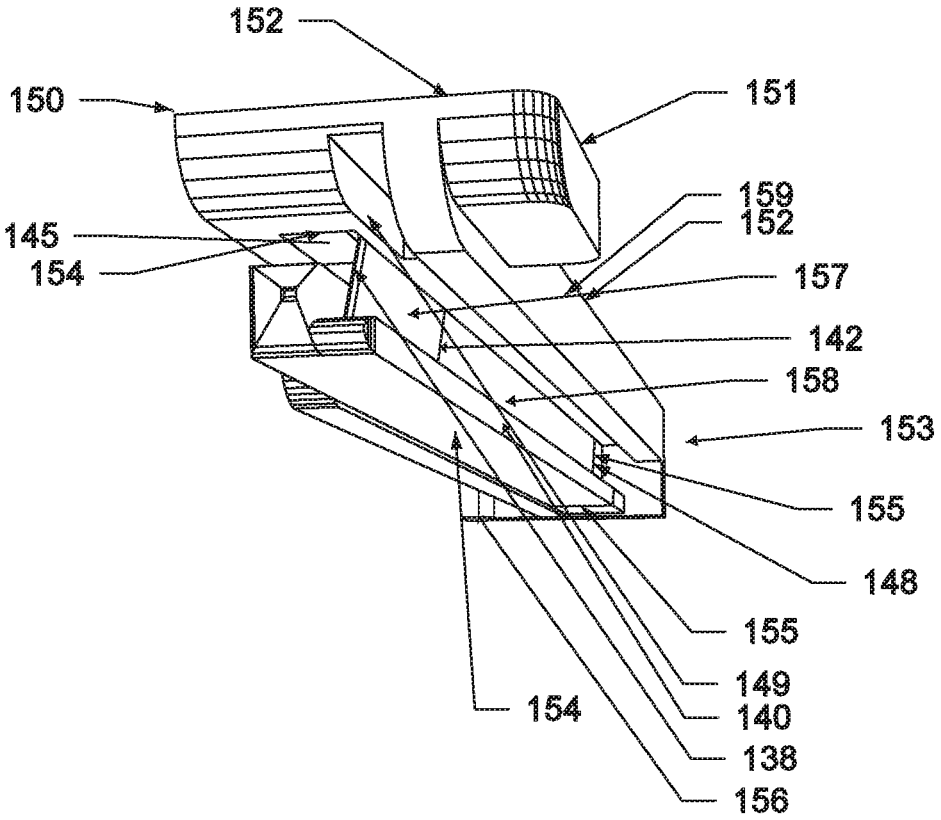
FIG. 23 illustrates the assembly of the sliding mechanism apparatus shown in FIGS. 20-22 in accordance with a third and fourth preferred embodiment of the present invention.
Figure 24:
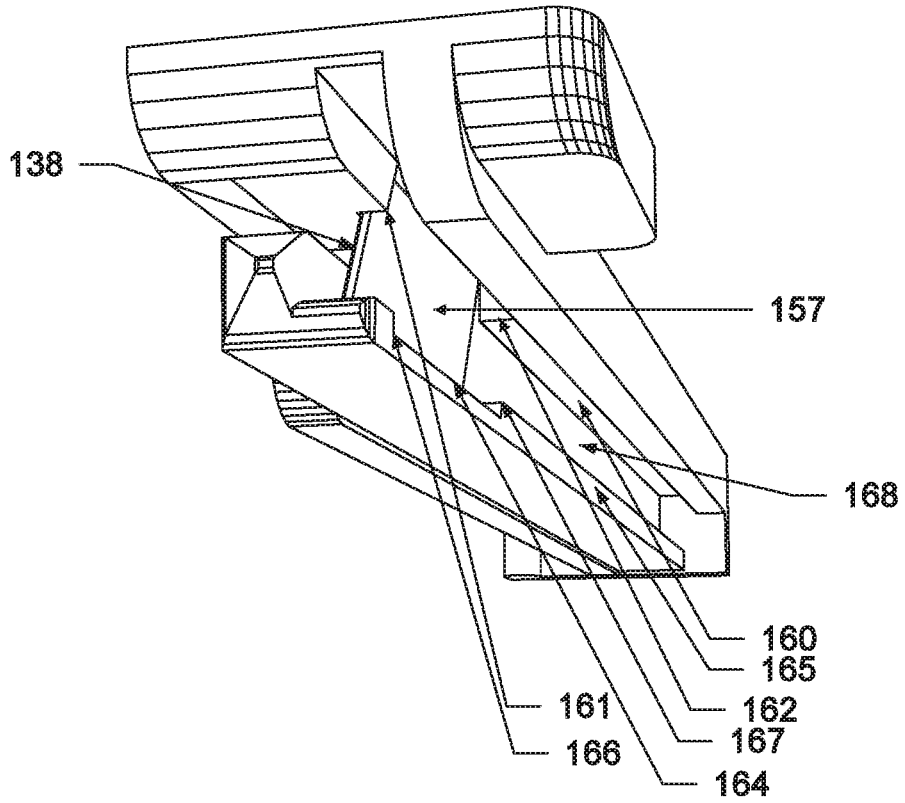
FIG. 24 is a perspective view of an alternative embodiment of the sliding mechanism apparatus and assembly shown in FIG. 23 in accordance with a third and fourth preferred embodiment of the present invention.
Figure 24A:
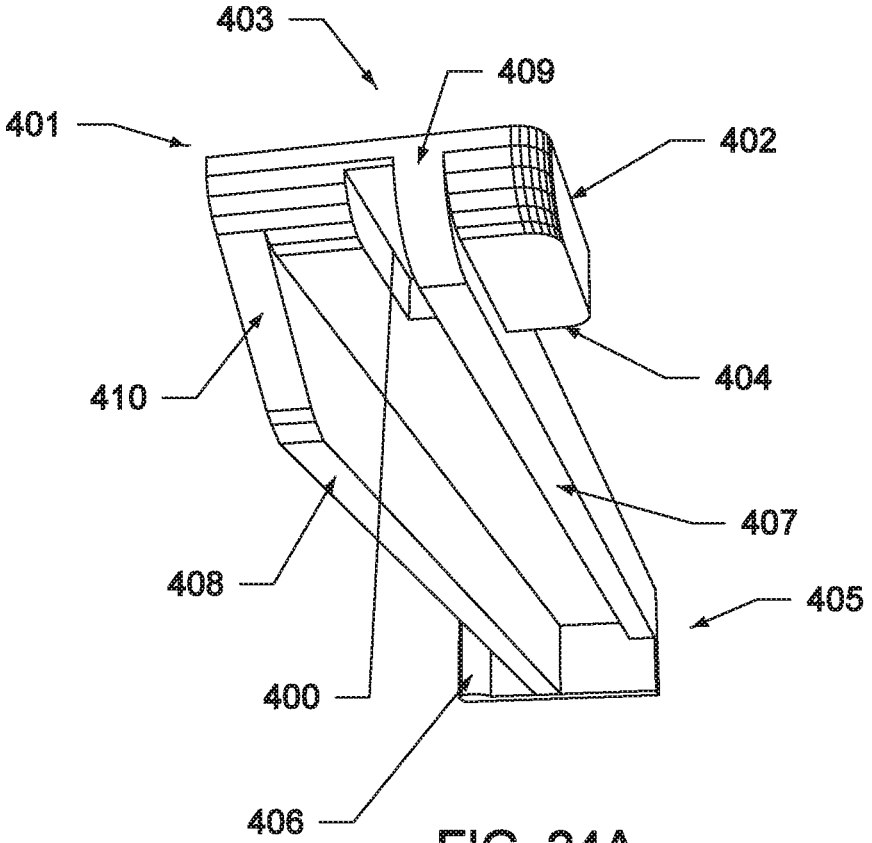
FIG. 24A is a perspective view of the underside of a third embodiment of the sliding mechanism apparatus in accordance with a third and fourth preferred embodiment of the present invention.
Figure 25:
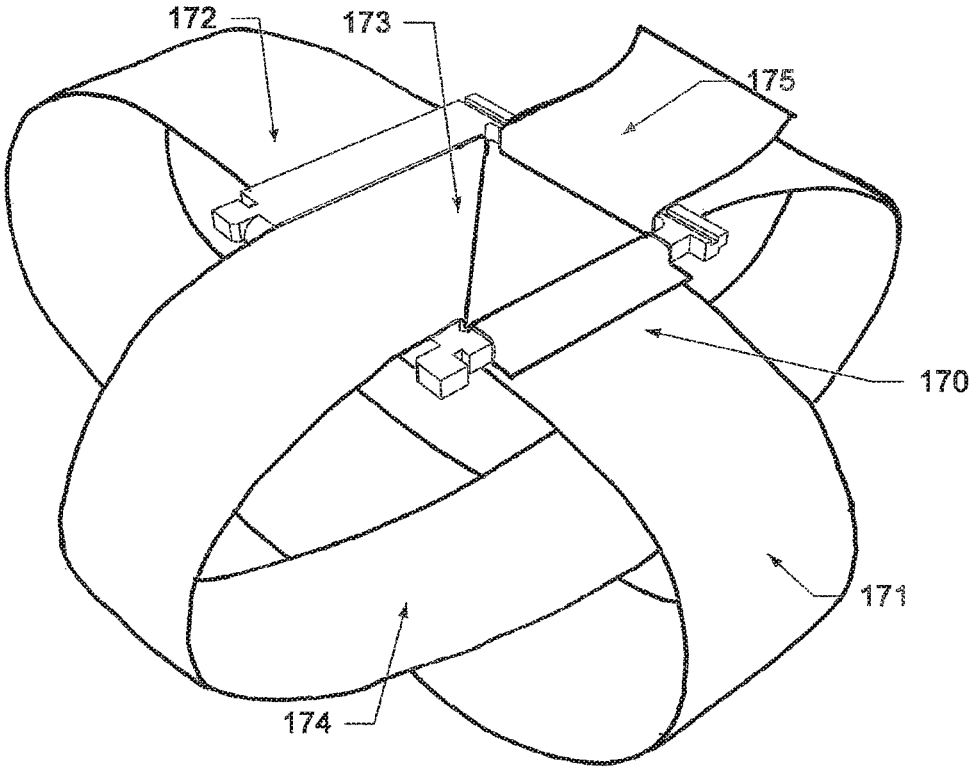
FIG. 25 illustrates a method for routing a ribbon through the routing apparatus in accordance with a third preferred embodiment of the present invention.
Figure 26:
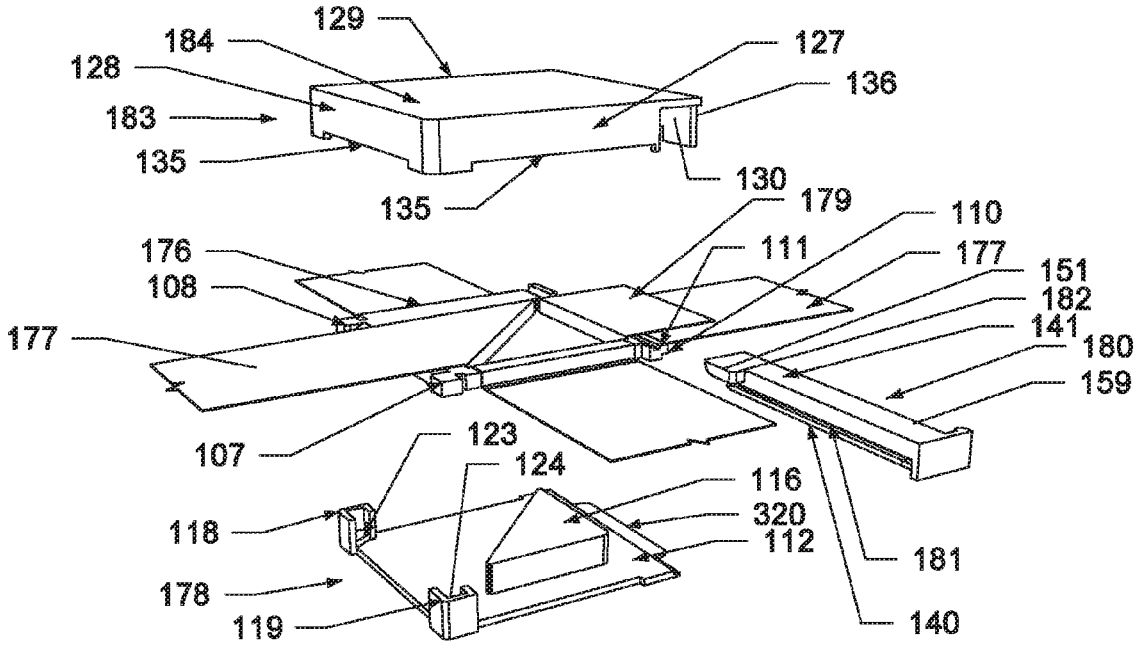
FIG. 26 illustrates the assembly of the routing apparatus, threaded ribbon, routing apparatus housing, and sliding mechanism in accordance with a third preferred embodiment of the present invention.
Figure 27A:
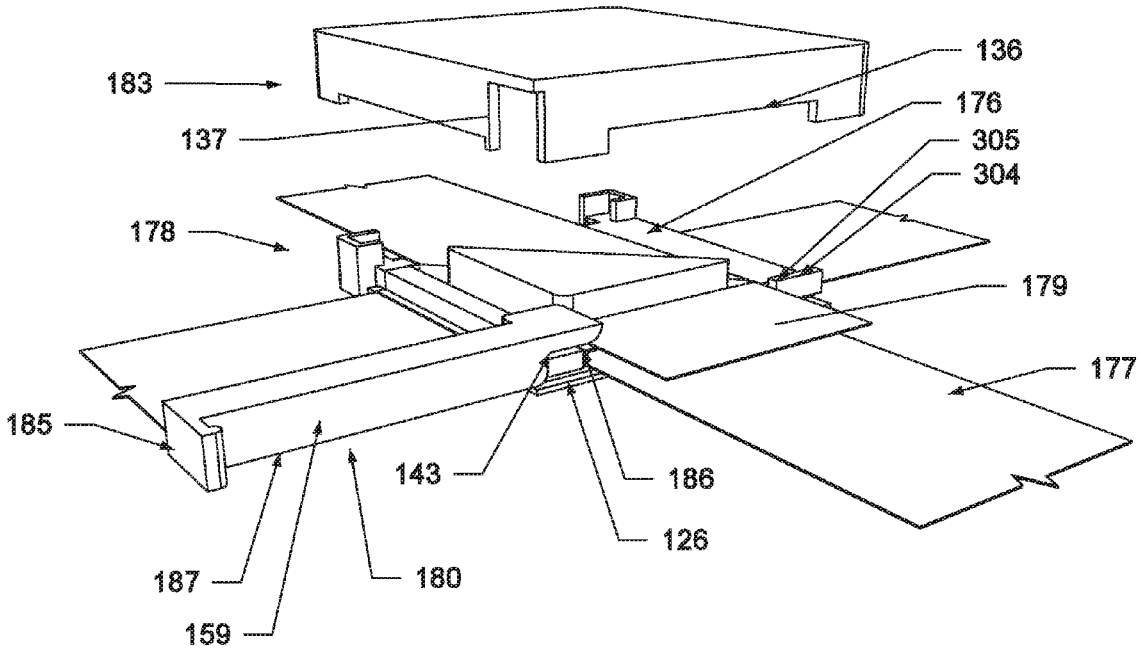
FIG. 27A illustrates the stroke of the sliding mechanism in accordance with a third and fourth preferred embodiment of the present invention.
Figure 27B:
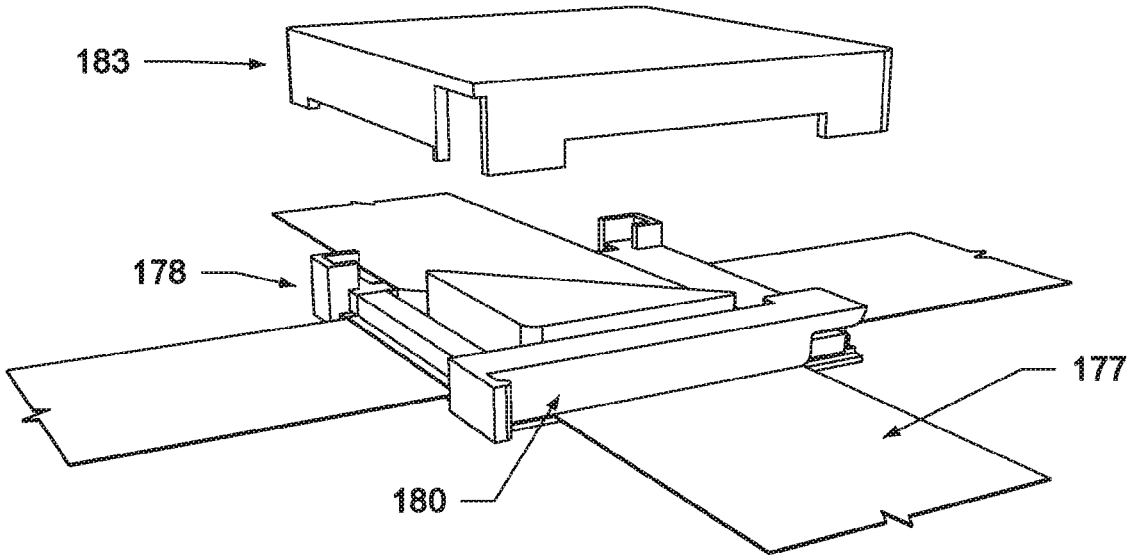
FIG. 27B illustrates the sliding mechanism in the engaged position in accordance with a third and fourth preferred embodiment of the present invention.
Figure 41:
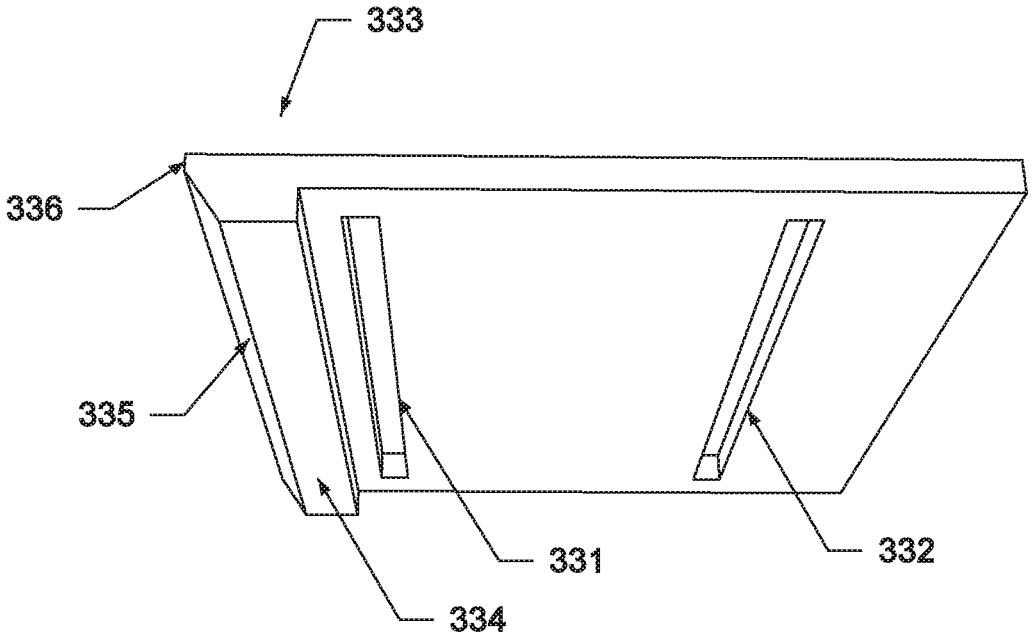
FIG. 41 is a perspective view of a sliding tag used in the third and fourth embodiments to assist in applying consistent pressure across the width of the ribbon during engagement of the sliding mechanism, as illustrated in FIGS. 27A-27B.
Figure 42:
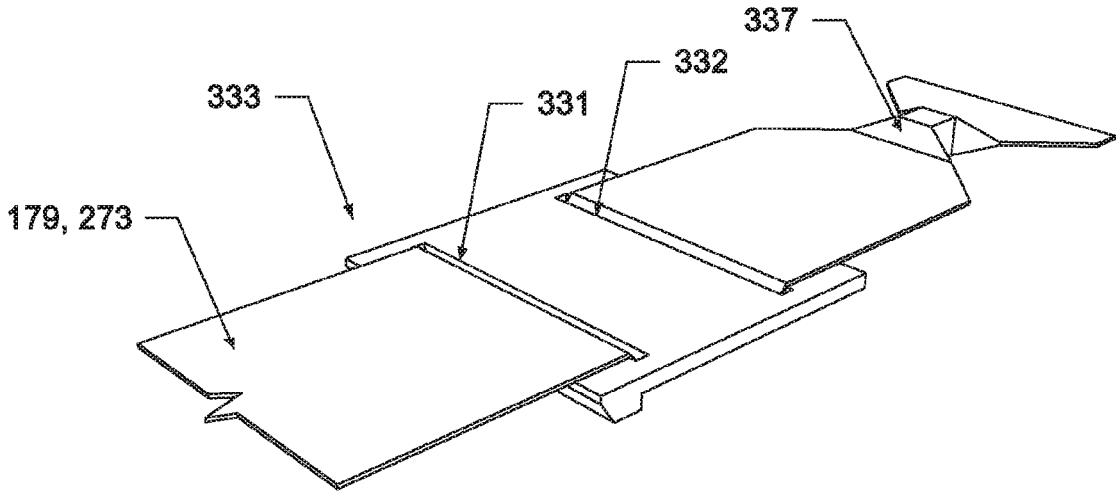
FIG. 42 illustrates a method for threading the ribbon through the sliding tag shown in FIG. 41.
Figure 43:
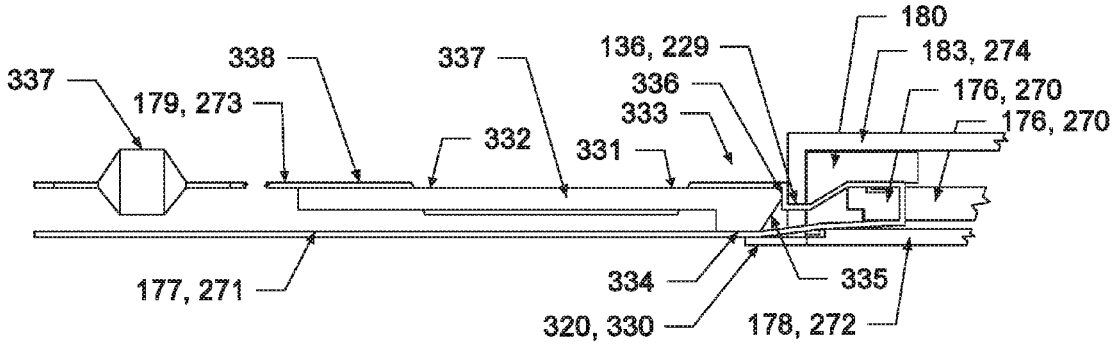
FIG. 43 illustrates a method for using the sliding tag shown in FIGS. 41-42 in accordance with a third and fourth preferred embodiment of the present invention.

Referring to FIGS. 15-28 and FIGS. 41-43, a third preferred embodiment of the present invention preferably is comprised of a single-piece routing apparatus (as shown in FIGS. 15-16), a two-piece functional housing therefor, comprised of a lower piece of the routing apparatus housing, or "cup" (as shown in FIGS. 17-18), an upper piece of the routing apparatus housing, or "lid" (as shown in FIG. 19), and a novel sliding apparatus in various embodiments (as shown in FIGS. 20-24) that simultaneously secures the ribbon after it has been pulled taut around the package or object being wrapped and cuts the excess ribbon. Alternatively, a sliding mechanism without a blade (as shown in FIG. 24A) preferably is used to secure the ribbon after it is pulled taut around the package, without cutting the ribbon. As illustrated in FIG. 25, a single length of non-elastic ribbon is routed through, with the first end attached to, the routing apparatus. As illustrated in FIG. 26, the routing apparatus, threaded with the ribbon, is combined with the cup and lid to function as an assembly, and a decorative and/or functional item is attached to the top of the lid. FIGS. 27A-27B illustrate the stroke of the sliding mechanism, as it is engaged to secure the ribbon in place and, in some embodiments, cut the excess ribbon for discarding. This assembly is used to decorate and/or secure a package or object, or a group thereof, as provided for in FIG. 28. FIGS. 41-43 show a sliding tag used to assist the user in applying consistent pressure and tension across the width of the ribbon during engagement of the sliding mechanism for more effective cutting and securing of the ribbon.

Because some of the preferred embodiments of the sliding mechanism (FIGS. 20-24) used in this third preferred embodiment of the present invention entail cutting of the ribbon, a thin, sheer nylon ribbon, without stiffening wire, is preferred. Use of a non-elastic ribbon of nominal thickness is assumed for purposes of illustration, and not by way of limitation. Accordingly, the relative measurements illustrated herein are solely illustrative, and are not intended to limit the scope of the invention to a particular thickness or width of ribbon or a particular measurement of the components of the invention. Further, the non-elastic ribbon used in the third and fourth embodiments may be pre-stretched before being routed through the routing apparatus to avoid sagging after being pulled taut for longer periods of time.

As in the first two preferred embodiments, the strength of the material from which the routing apparatus is made will determine the optimal measurements of this third embodiment, being the minimum dimensions at which the routing apparatus can withstand the force created by the maximum linear tension of the non-elastic ribbon when wrapped around a package or object. Minimizing the dimensions of the routing apparatus and its housing, in turn, minimizes the appearance of the routing apparatus' housing on the package or object to be wrapped. Like the first two preferred embodiments, the final optimal dimensions of the routing apparatus in this third preferred embodiment will likely depend on the end user's balancing of cost against minimization of the appearance of the routing apparatus' housing when placed on the package or object to be wrapped.

FIG. 15 is a top plan view of a ribbon routing apparatus in accordance with a third preferred embodiment of the present invention, which preferably is formed from a single piece of material substantially in the shape shown. As in the first preferred embodiment, the triangular void 100 is positioned within the routing apparatus, or body, such that the legs 101, 102 forming the right angle are set in from the sides 103 of the body 104, and the hypotenuse 105 of the triangular void 100 transverses the outer square of the body 104 substantially at a forty-five degree (45°) diagonal angle relative to the outer sides 103. The void 100 is preferably triangular, but is not so limited and may have nearly any size and/or shape that accommodates routing of the ribbon therethrough. The void 100 is preferably positioned within the outer square 104 of the body so that the sides 101, 102 forming the right angle are set in from the corresponding outer sides 103 of the body, and the hypotenuse 105 of the triangular void 100 transverses the body at a forty-five degree (45°) diagonal angle relative to the outer sides 103 of the body 104. The hypotenuse 105 is not limited to being positioned at the preferred forty-five degree (45°) angle relative to the sides 103 and may be positioned at nearly any angle, such as an acute angle less than forty-five degrees (45°), permitting routing of the ribbon around an object, such as a package, at angles other than ninety degrees (90°) or such that the ribbon is wrapped around a surface area of the object different from that shown in the preferred embodiments herein.

FIG. 16 is a perspective view of the ribbon routing apparatus shown in FIG. 15. As shown, two strips or legs 101*a*, 102*a* of material remain on two adjacent sides of the outer square of the body 104, preferably resembling square rods joined at a right angle, and an inner face 109 is formed by the hypotenuse 105 of the triangular void 100. The legs preferably include a first leg 101*a* and a second leg 102*a* that are positioned at two sides of the void 100. The first and second legs 101*a*, 102*a* preferably define first and second acute angles relative to the hypotenuse or routing edge 109. The first and second angles are preferably forty-five degrees (45°) such that the void has its preferred right isosceles triangular-shape, but is not so limited to such shape. The body 104 has a first surface 104*a* and a second surface 104*b* that define a thickness T therebetween. The first leg 101*a* also preferably defines a first length $L_1$ and the second leg 102*a* preferably defines a second length $L_2$. The first and second lengths $L_1$, $L_2$ are greater than the thickness T.

All edges over which the ribbon travels or rests or comes into close proximity (as shown in FIG. 25) preferably are slightly rounded to avoid snagging the ribbon (for clarity, this rounding is not shown). The edge 106 between the two tabs 107, 108 preferably is a full quarter round. The inner face 109 of the triangular void's hypotenuse 105 preferably is significantly rounded, up to a full half round (for clarity, this rounding is not shown). A first groove 110 preferably is formed on the outside edge of the bottom face of the routing apparatus, extending the full length of the side on which it is formed. This underside groove 110 accepts the lower rail 140 of the blade holder 158 component of the sliding mechanism shown in FIG. 23. As shown in FIG. 16, a second groove 111 preferably is formed slightly inset on the top face of the routing apparatus, extending the full length of the routing apparatus. This topside groove 111 accepts the upper rail 181 of the sliding mechanism 180 as shown in FIG. 27A.

As shown in FIG. 16, one small notch 301 preferably is formed in the inner face of the topside groove 111, and another small notch 302 preferably is formed in the outer face of the topside groove 111. The faces of these notches 301, 302 that are closest to the middle of the topside groove 111 preferably are substantially vertical. As the sliding mechanism (180 in FIG. 27A) is engaged, the upper rail 181 (FIG. 27A) of the sliding mechanism 180 (FIG. 27A) presses the ribbon into the topside groove 111 of the routing apparatus and the notches 301, 302 catch the stitching on the side of the ribbon to prevent the ribbon from being pushed inward and from bunching as the sliding mechanism is engaged (as shown in FIGS. 27A-27B). The remaining face of each notch 301, 302 is angled upward from the bottom edge of the vertical face to the top face of the routing apparatus as shown. The vertical face of the outer recess 302 preferably is slightly closer to the middle of the topside groove 111 than is the vertical face of the inner recess 301. This slight offset allows the outer recess 302 to catch the ribbon's side stitching even if the loose end 179 of the ribbon (as shown in FIG. 27A) is pulled at an angle other than perpendicular to the second leg of the routing apparatus. For the same reason, the angled face of the outer notch 302 preferably extends further toward the outside square 104 of the routing apparatus than does the angled face of the inner notch 301. At the other end of the topside groove 111, on the thin strip 303 on the outside of the topside groove 111, a flat surface 304 preferably is raised from the top face of the routing apparatus. The inside vertical face 305 of this raised surface 304 is positioned slightly to the outside of the loose end 179 of the ribbon 177 when pulled perpendicular to the bar of the routing apparatus as shown in FIG. 27A. The inside vertical face 305 of the raised surface 304 stops the stitching on the side of the ribbon from sliding sideways at the end of the stroke of the sliding mechanism as it is engaged (as shown in FIGS. 27A-27B), forcing the loose end 179 of the ribbon 177 (FIG. 27A-27B) across the cutting edge 138 of the blade 157 of the sliding mechanism (as shown in FIG. 24).

FIG. 17 is a top plan view of the lower piece, or cup, of the routing apparatus housing according to the third embodiment. The cup's base 112 preferably is substantially in the shape shown. All corners 113 of the cup's base 112 preferably are slightly rounded, except for the corner 114 nearest the right angle of the raised triangular surface 115. A platform 320 with rounded corners extends from one side. The bottom of the sliding tag shown in FIGS. 41-42 rests on this platform 320 (as illustrated in FIG. 43) during engagement of the sliding mechanism (as illustrated in FIGS. 27A-27B).

FIG. 18 is a perspective view of the cup shown in FIG. 17. As shown in FIG. 18, at two corners 116, 117 of the cup's base 112, walls 118, 119 substantially in the shape shown are raised upward perpendicularly to the cup's base 112. All edges of the walls 118 preferably are slightly rounded over to avoid snagging the ribbon (for clarity, this slight rounding is not shown). Three of the sides of the cup's base are inset to create voids 120, 121, 122 slightly wider than the ribbon, in which the ribbon will rest and/or slide. The surfaces forming these voids 120, 121, 122 preferably are slightly rounded over to avoid snagging the ribbon (for clarity, this rounding is not shown). Within the perimeter of each set of the walls 118, 119, a flat-topped surface 123, 124 is elevated from the cup's base 112. A flat-topped surface 116 substantially in the shape of a right isosceles triangle, corresponding to the placement of the triangular void of the routing apparatus, is raised up from the top face of the cup's base 112 to the same height as the walls 118, 119 at the corners of the cup. Along one outer edge 125 of the cup's base 112, a groove 126 is formed in the cup's base 112. From that outer edge 125, a platform 320 with rounded corners extends, on which the sliding tag shown in FIGS. 41-42 will rest (as illustrated in FIG. 43) during engagement of the sliding mechanism (as illustrated in FIGS. 27A-27B).

FIG. 19 is a perspective view of the upper piece, or lid, of the routing apparatus housing. The lid consists of vertical walls 127, 128, 129, 130 that wrap around the perimeter of the cup (shown in FIGS. 17-18), slightly offset outward from the cup to permit the lid to slide down over the cup's walls and the sliding apparatus and assembly (shown in FIGS. 20-25). Three corners 131, 132, 133 of the lid's walls are slightly rounded to correspond to the rounded corners of the cup's base (shown in FIG. 17 at 113). A flat surface 134 is formed atop, and connected to, the lid's walls. From the base of three 127, 128, 129 of the lid's walls, a void 135 is formed that is slightly wider than the ribbon. From the base of the fourth wall 130, a higher void 136 is formed that is slightly wider than the ribbon. All edges of the voids 135, 136 through which ribbon travels are slightly rounded to avoid snagging the ribbon (for clarity, this slight rounding is not shown). On the wall 127 adjacent to the wall 130 containing the fourth, and tallest, void 136, there is a void 137 as shown (through which the sliding apparatus and assembly will travel).

The third and fourth preferred embodiments of the invention utilize a sliding apparatus and assembly, or "sliding mechanism," (as shown in FIGS. 20-24) that, in all embodiments, secures the ribbon after it has been pulled taut around the package or object being wrapped, and in some embodiments, simultaneously cuts the excess ribbon for discarding. The first preferred embodiment of the sliding mechanism consists of three separate pieces: (1) a blade (shown in FIG. 20), (2) a blade holder (shown in FIG. 21), and (3) a blade cap (shown in FIG. 22).

Figure 20:
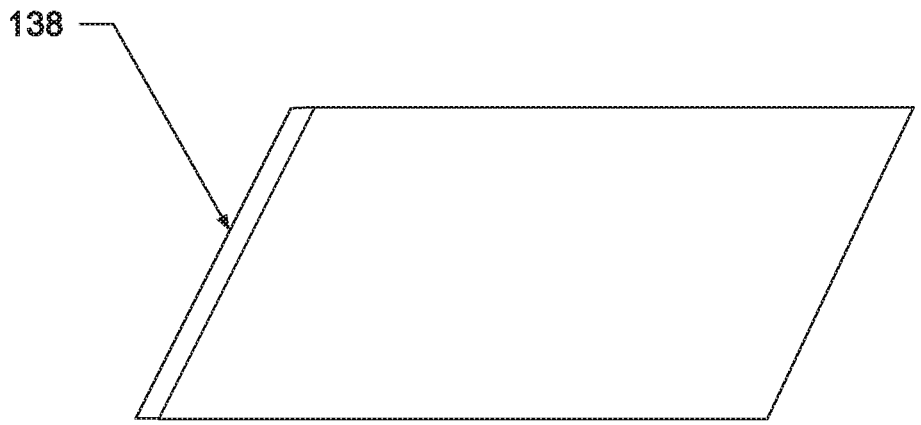
FIG. 20 is a side elevation view of a cutting blade.

FIG. 20 is a side elevation view of a cutting blade substantially in the rhombus shape shown according to the first and second preferred embodiments of the sliding mechanism for use in the third and fourth preferred embodiments of the invention. The blade is made of hard metal, and one of the short sides 138 is formed into a cutting edge by filing, grinding, etc.

Figure 21:
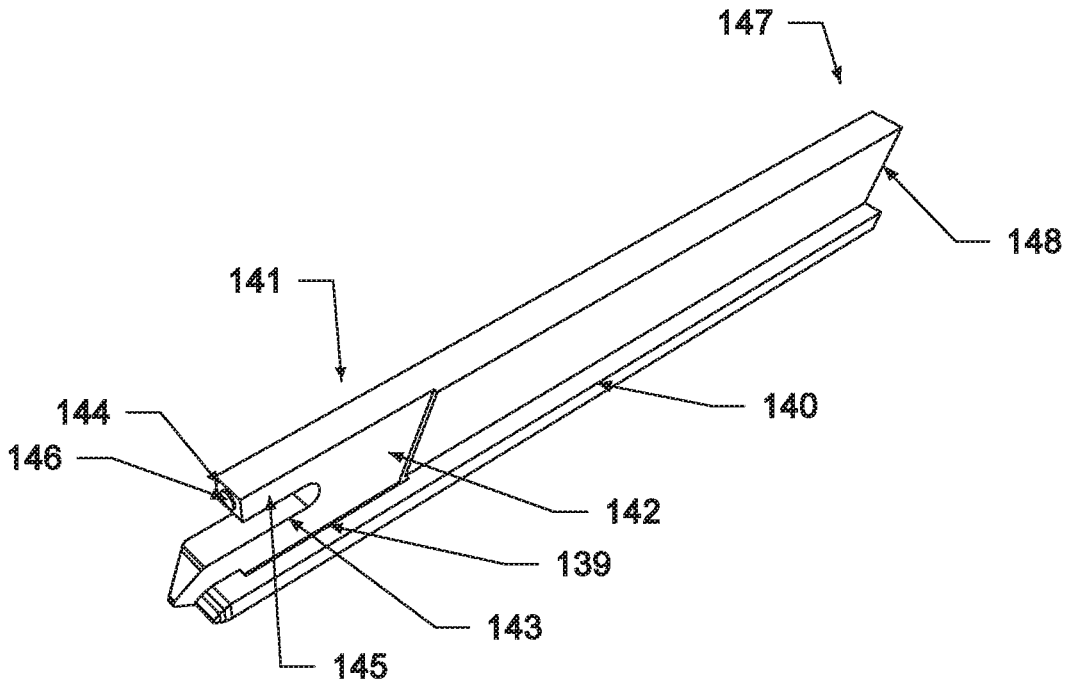
FIG. 21 is a perspective view of a blade holder of a sliding mechanism apparatus and assembly in accordance with a third and fourth preferred embodiment of the present invention.

FIG. 21 is a perspective view of the blade holder of a first preferred embodiment of a sliding mechanism in accordance with the third and fourth preferred embodiments of the present invention. The inner blade holder preferably is formed from a single piece of material substantially in the shape shown. A slot 139 to accept the blade is formed in the lower rail 140 of the leading side 141 of the blade holder. A recess 142 slightly wider than the blade is formed into the leading side 141 above the blade slot 139. Also at the leading side 141, a void or notch 143 is formed, in which the ribbon will slide to contact the blade. The upper forward face 144 of the piece 145 above this void 143 has a small male nub 146. The trailing end 147 of the blade holder is cut at an angle 148 as shown.

Figure 22:
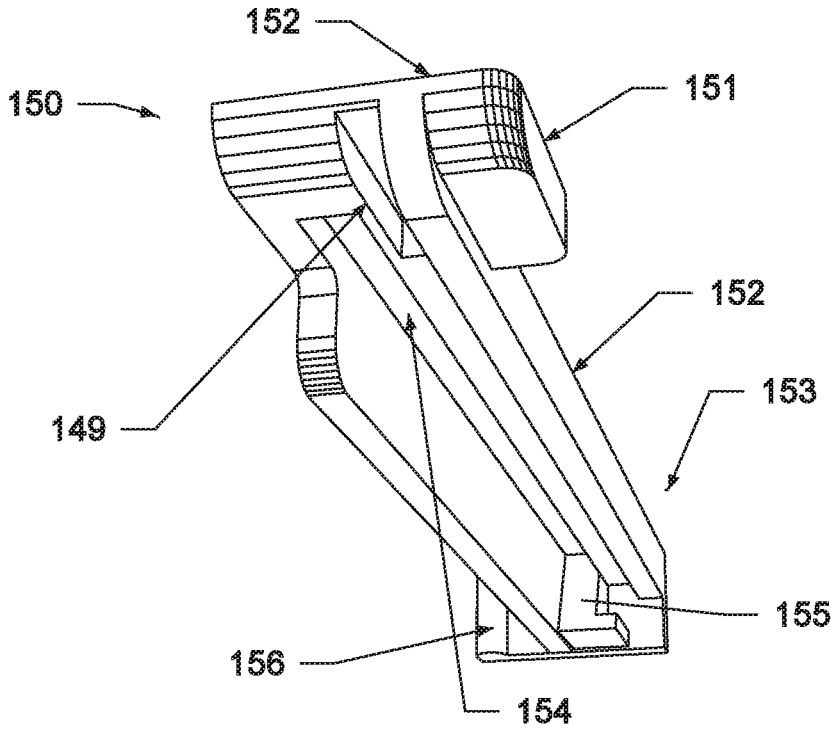
FIG. 22 is a perspective view of the blade cap of a sliding mechanism apparatus and assembly in accordance with a third and fourth preferred embodiment of the present invention.

FIG. 22 is a perspective view of the underside of the blade cap of the first preferred embodiment of the sliding mechanism according to the third and fourth embodiments of the invention. The blade cap is formed from a single piece of material substantially in the shape shown. A void 149, corresponding to the raised flat surface 304 of the routing apparatus (as shown in FIG. 16), is formed in the leading side 150 of the blade cap, in which void 149 the raised flat surface 304 rests at the end of the sliding mechanism's stroke (as shown in FIG. 27A-27B). A slightly rounded tab 151 protrudes from the top surface 152 of the leading side 150 of the blade cap. When the sliding mechanism is in the disengaged position (as shown in FIG. 27A), the trailing side 153 (FIG. 23) of this rounded tab 151 contacts the inside of the vertical wall 127 (in FIG. 19), 223 (in FIG. 33) of the lid 183 (in FIG. 26), 274 (in FIG. 39) to prevent the disengaged sliding mechanism from escaping the sealed routing apparatus housing. An inner slot 154 is formed in the underside of the blade cap's top surface 152 that corresponds to the vertical beam at the top portion of the blade holder shown in FIG. 21. The trailing end 153 of the blade cap, is formed at an angled face 155 as shown, which angle is substantially the same as the angle 148 of the trailing end 147 of the blade holder, as shown in FIG. 21. At the trailing end 153 of the blade cap, a tab 156 is formed as a finger grip for disengaging the sliding mechanism. This finger-grip tab 156 is positioned on the side of the blade cap opposite the rounded tab 151. The surfaces in the leading side 150 of the blade cap are rounded downward and toward the trailing end 153 of the blade cap to guide the ribbon into the notch 143 in the blade holder where the blade contacts the ribbon (as shown in FIG. 21) and to guide the ribbon into the groove 111 in the top face of the routing apparatus (as shown in FIG. 16).

FIG. 23 illustrates the assembly of the first preferred embodiment of the sliding mechanism shown in FIGS. 20-22 in accordance with the third and fourth preferred embodiments of the invention. As shown in FIG. 23, the blade 157 is inserted into the blade slot 139 (not shown) in the lower rail 140 of the blade holder 158, with the cutting edge 138 toward the leading side 150 of the blade holder 158, and rests in the corresponding recess 142 in the leading side 141 of the blade holder 158. The angled face 148 in the trailing side 153 of the blade holder 158 is inserted at a slightly downward angle into the corresponding angled face 155 in the trailing side 153 of the blade cap 159. The blade holder 158 is rotated upward into the inner slot 154 in the blade cap 159. The small male nub 146 (not shown) on the upper forward surface 144 (not shown) on the upper portion 145 of the leading side 141 of the blade holder 158 snaps into a corresponding female void (not shown) in the inner slot 154 (shown in FIG. 22) in the underside of the blade cap 159.

The angled face 148 on the trailing side 153 of the blade holder 158 rests against the corresponding angled face 155 in the trailing side 153 of the blade cap 159. The horizontal pressure of the blade cap's 159 angled face 155 pushes the blade holder 158 in tandem with the blade cap 159 as the sliding mechanism is engaged (illustrated in FIGS. 27A-27B). The forward surface 144 (not shown) on the upper portion 145 of leading side 150 of the blade holder 158 presses against a corresponding surface 154 in the blade cap 159 to secure the blade holder 158 and blade cap 159 together and to push them in tandem as the sliding mechanism is disengaged (illustrated in FIG. 27A). The upward vertical pressure of the blade cap's 159 angled face 155 supports the trailing side 153 of the blade holder 158, and prevents it from falling downward and out of the blade cap 159 when the sliding mechanism is disengaged (illustrated in FIG. 27A). Downward vertical pressure is applied to the leading side 141 of the sliding mechanism by the bottom face of the routing apparatus lid 183 when attached to the routing apparatus cup 178, as illustrated in FIG. 26. The combination of vertical and horizontal pressure points within the sliding mechanism assembly holds the blade 157, blade holder 158, and blade cap 159 securely together and maintains the substantially constant position of the sliding mechanism's individual pieces while at rest and during engagement and disengagement.

FIG. 24 is a perspective view of a second preferred embodiment of the sliding mechanism assembly shown in FIG. 23 according to the third and fourth preferred embodiments of the invention. In this second preferred embodiment of the sliding mechanism, the blade holder and blade cap are combined and made from a single piece of material substantially in the shape shown. A void is formed in the inside upper surface 160 of the sliding mechanism to accept the blade 157. The leading side 161 of this upper void is angled to correspond to the angle of the cutting edge 138 of the blade 157. The trailing side 162 of the upper void extends upward from, and perpendicular to, the inside upper surface 160 of the sliding mechanism, beginning at a point slightly to the trailing side of the blade's upper trailing point. Another void 164 is formed in the lower inner rail 165 of the sliding mechanism to accept the blade 157. The leading side 166 of this lower void 164 extends upward from, and perpendicular to, the top face of the lower void 164. The trailing side 167 of this lower void 164 is angled to correspond to the trailing edge of the blade 157. To assemble this alternative embodiment of the sliding mechanism, an adhesive is applied to the inner face of the trailing side of the blade and/or to the corresponding area on the inner face of the main vertical beam 168 of the sliding mechanism. The top edge of the blade 157 is tilted inward toward the main vertical beam 168 of the sliding mechanism and the top side of the blade 157 is inserted into the upper void 160. Once the top edge of the blade 157 is seated in the upper void 160, the lower edge of the blade is rotated into the lower void 164, such that the bottom edge of the blade 157 rests on the top face of the lower void 164. Upon contact of the inner face of the blade 157 with the inner face of the main vertical beam 168 of the sliding mechanism, the adhesive secures the blade 157 in position.

FIG. 24A is a perspective view of the underside of a third preferred embodiment of a sliding mechanism according to the third and fourth preferred embodiments of the invention. Unlike the first and second preferred embodiments of the sliding mechanism, this third preferred embodiment does not cut the excess ribbon as the sliding mechanism is engaged, allowing thicker ribbon materials to be used in the third and fourth preferred embodiments of the invention.

As shown in FIG. 24A, the sliding mechanism is formed from a single piece of material substantially in the shape shown. A void 400, corresponding to the raised flat surface 304 of the routing apparatus (as shown in FIG. 16), is formed in the leading side 401 of the sliding mechanism, in which void 400 the raised flat surface 304 (FIG. 16) rests at the end of the sliding mechanism's stroke (as shown in FIG. 27B). A slightly rounded tab 402 protrudes from the top surface 403 of the leading side 401 of the sliding mechanism. When the sliding mechanism is in the disengaged position (as shown in FIG. 27A), the trailing side 404 of this rounded tab 402 contacts the inside of the vertical wall 127 (in FIG. 19), 223 (in FIG. 33) of the lid 183 (in FIG. 26), 274 (in FIG. 39) to prevent the disengaged sliding mechanism from escaping the sealed routing apparatus housing. At the trailing end 405 of the sliding mechanism, a tab 406 is formed as a finger grip for disengaging the sliding mechanism.

The inside upper rail 407 of the sliding mechanism corresponds to, and slides within, the groove 111 (in FIG. 16), 209 (in FIG. 30) in the top side of the routing apparatus, to pinch the ribbon and hold it in place as the sliding mechanism is engaged (as illustrated in FIGS. 27A, 27B). The leading edge 409 of the inside upper rail 407 preferably is rounded to guide the ribbon into the groove 111 (in FIG. 16), 209 (in FIG. 30) in the top face of the routing apparatus. The outside lower rail 408 of the sliding mechanism corresponds to, and slides within, the groove 126 (in FIG. 18), 221 (in FIG. 32) in the top face of the cup, to pinch the ribbon and hold it in place as the sliding mechanism is engaged, as illustrated in FIGS. 27A-27B. The leading edge 410 of the outside lower rail 408 is angled and slightly rounded at the ends to guide the ribbon into the groove 126 (in FIG. 18), 221 (in FIG. 32) in the top face of the cup.

FIG. 25 illustrates a first preferred method for routing a ribbon through the routing apparatus shown in FIGS. 15-16 according to the third preferred embodiment of the invention. At step 170, one end of a single length of non-elastic ribbon is attached to one bar of the routing apparatus by looping the ribbon around the bar from the bottom and attaching the ribbon on top of itself by stapling, sewing, riveting, etc. At step 171, the other end of the ribbon is then routed down into space and back up to the opposite side of the routing apparatus to create a loop beneath the routing apparatus. At step 172, the loose end of the ribbon is threaded under the bottom face of the routing apparatus. At step 173, the ribbon is threaded up through the triangular void in the routing apparatus, and is folded over the hypotenuse of the triangular void to the top side of the routing apparatus, turning the ribbon substantially at a right angle from its initial direction of travel. At step 174, once the ribbon is turned at a right angle, the ribbon is then threaded from the top side of the routing apparatus, perpendicularly over the edge of the routing apparatus, and down into space, crossing above the first loop of ribbon substantially perpendicularly, and back up to the opposite side of the routing apparatus. At step 175, the loose end of the ribbon approaches the routing apparatus substantially parallel to the bottom face, passes under and loops over the grooved bar of the routing apparatus, and lays back on itself in the opposite direction. As a result, the ribbon emanates in four directions from the routing apparatus, with each direction of ribbon being substantially centered on, and traveling substantially perpendicular to, each side of the outer square of the routing apparatus.

As a second preferred method for routing a ribbon through the routing apparatus shown in FIGS. 15-16 according to the third preferred embodiment of the invention, at step 174, the second loop of ribbon beneath the routing apparatus crosses below the first loop of ribbon substantially perpendicularly. This second preferred method for routing a ribbon allows the user to employ the completed assembly shown in FIG. 26 to encircle the package with a ribbon in only one direction, rather than the crossed ribbon configuration described in relation to FIG. 26. This second preferred method nearly doubles the amount of ribbon available for encircling the package, while maintaining the pre-configured assembly shown in FIG. 26. Specifically, rather than sliding the inner loop of ribbon around the package or object, as described in relation to block 191 in FIG. 28, the user preferably pulls the inner loop of ribbon taut against the bottom face of the cup 178 (FIG. 26). By shortening the length of the inner loop of ribbon, the length of the outer loop is correspondingly increased by the same length.

FIG. 26 illustrates the assembly of the routing apparatus, threaded ribbon, cup, lid, and sliding mechanism according to the third preferred embodiment. Once the ribbon has been threaded through the routing apparatus as shown in FIG. 25, the routing apparatus 176 and ribbon 177 are placed in the cup as shown in FIG. 26 (for clarity, the segments of ribbon emanating from the routing apparatus are shown truncated). The tabs 107, 108 on one side of the routing apparatus 176 fit within the walls 118, 119 on the cup 178 to hold the routing apparatus 176 in position. The interlocking of the tabs 107, 108 within the walls 118, 119 on the cup 178 holds the routing apparatus 176 in place as the ribbon 177 is pulled taut by its loose end 179 and as the sliding mechanism 180 is engaged, and prevents dislodging or misalignment of the sliding mechanism 180 as the ribbon 177 is pulled taut by its loose end 179. The tabs 107, 108 of the routing apparatus 176 rest on the raised surfaces 123, 124 within the perimeter of the cup's raised walls 118, 119 to elevate two corners 107, 108 of the routing apparatus 176 within the cup 178. Elevating the routing apparatus 176 slightly prevents the downward pressure, created by tightening of the ribbon 177 as it travels over the top face of the routing apparatus 176, from pressing down on the ribbon 177 routed under the bottom face of the routing apparatus 176 and pinching the ribbon and hindering its travel.

The groove 111 in the top face of the routing apparatus 176 corresponds to and accepts the inside upper rail 181 of the sliding mechanism 180. The groove 110 in the bottom face of the routing apparatus 176 corresponds and accepts the inward facing horizontal rail 140 of the sliding mechanism 180. Both groove and rail pairs serve to maintain a straight path of travel for the sliding mechanism 180 as it is engaged. The groove 111 in the top face of the routing apparatus and its corresponding rail 181 pinch the loose end of ribbon 179 to hold the ribbon 177 in place and secure it once pulled taut around the package. The bottom face of the inward facing horizontal rail 140 presses the ribbon 177 onto the top face 112 of the cup's base to further secure the ribbon 177 once it is pulled taut around the package. The groove 126 (in FIG. 18, not shown here) in the top face of the cup's base corresponds to and accepts the outside lower rail 408 (in FIG. 24A, not shown here) of the sliding mechanism.

The leading side 141 of the inside upper rail 181 and inward facing horizontal rail 140 of the sliding mechanism 180 are placed into the corresponding upper groove 111 and lower groove 110 of the routing apparatus 176, and the sliding mechanism 180 slides onto the routing apparatus 176 slightly beyond the point where the trailing edge 182 of the sliding mechanism's stop tab 151 is within the vertical perimeter of the cup's base 112. The sliding mechanism's lower rail 140 elevates slightly the side of the routing apparatus 176 opposite the routing apparatus' interlocking tabs 107, 108.

The lid 183 is lowered down onto and around the cup 178, and the sliding mechanism 180 remains in a disengaged position. The top face of the triangular surface 116 of the cup 178 is attached to the bottom face 134 (not shown) of the lid's top surface 184. Once the lid is seated and attached, the bottom faces of the voids 135 in the lower sides of three of the lid's walls 127, 128, 129 press the corresponding segments of the ribbon 177 flat against the top of the package or object being wrapped.

For narrow width ribbon (less than one inch in width), a tag (not shown here) made of relatively stiff material, such as paper card stock, and which is wider than the void 136 in the wall 130 of the lid 183 through which the loose end of the ribbon travels, is attached to the loose end 179 of the ribbon to prevent the ribbon from inadvertently being unthreaded from the routing apparatus 176. This tag attached to the loose end 179 of the ribbon is discarded after the ribbon has been pulled taut around the package and the sliding mechanism is engaged to cut the excess ribbon, as illustrated in FIG. 27B and provided for in FIG. 28. For wider ribbon (one inch or more), the sliding tag shown in FIG. 41 (not shown here) is threaded with the ribbon as illustrated in FIG. 42. This sliding tag is wider than the void 136 in the wall 130 of the lid 183 through which the loose end of the ribbon travels, which prevents the ribbon from inadvertently being unthreaded from the routing apparatus 176.

These parts and steps result in an assembly consisting of the routing apparatus 176, with a single length of non-elastic ribbon 177 routed through and attached to the routing apparatus 176 (as illustrated in FIG. 25), the cup 178, and the lid 183. A decorative and/or functional item is attached to the top face 184 of the routing apparatus' lid, such as a decorative bow (made from the ribbon material), a box of crayons, silk flowers, a box of chocolates, etc.

To further minimize the appearance of the routing apparatus' housing when placed on the package or object to be wrapped, the material forming the components preferably is colored to match or complement the dominant color of the ribbon used.

FIG. 27A is a perspective view of the assembly of the routing apparatus 176, ribbon 177, cup 178, assembled sliding mechanism 180, and lid 183, and illustrates the stroke of the sliding mechanism 180 according to the third and fourth preferred embodiments of the invention. The sliding mechanism 180 is engaged by pushing (with a finger) the rear face 185 of the sliding mechanism 180 into the corresponding void 137 in the lid 183. When pushed, the sculpted point 186 on the leading side of the sliding mechanism 180 slides in between and separates the segment 177 of ribbon (being the single length of ribbon routed through the routing apparatus 176) passing under the bottom face of the routing apparatus 176 from the segment of ribbon 179 passing over the top face of the routing apparatus 176. This method of separating the upper segment 179 of ribbon and the lower segment 177 of ribbon permits the sliding mechanism 180 to treat the two segments of ribbon differently. By engaging the sliding mechanism 180, the lower segment 177 of ribbon is pinched and pressed to secure the ribbon in place, while the upper segment 179 of the ribbon that exits the corresponding void 136 in the lid 183 is cut as excess for discarding. Specifically, the inside upper rail 181 (FIG. 16, not shown here) of the sliding mechanism 180 presses the ribbon into the topside groove 111 (FIG. 16, not shown here) of the routing apparatus and the notches 301, 302 (FIG. 16, not shown here) of the routing apparatus catch the stitching on the side of the ribbon to prevent the ribbon from being pushed sideways and from bunching as the sliding mechanism is engaged. The inside vertical face 305 of the raised surface 304 at the end of the sliding mechanism's 180 stroke stops the stitching on the side of the ribbon from sliding sideways at the end of the stroke of the sliding mechanism as it is engaged, which forces the loose end 179 of the ribbon 177 across the cutting edge 138 of the blade 157 of the sliding mechanism (shown in FIG. 24).

As shown in FIG. 27A, the inward facing horizontal rail 140 (not shown) of the sliding mechanism 180 lifts the routing apparatus 176 slightly to apply upward pressure to the routing apparatus 176, which creates corresponding downward pressure by the upper rail 181 (not shown) of the sliding mechanism 180 to pinch the ribbon 177 into the groove 111 (not shown) on the top face of the routing apparatus 176. In addition, the outside lower rail 187 of the sliding mechanism 180 pinches the ribbon 177 in the outside lower groove 126 of the cup 178, and the upper rail 181 of the sliding mechanism 180 pinches the ribbon into the groove 111 (not shown) on the top face of the cup 178. The bottom face of the blade holder 158 (not shown) presses the ribbon 177 down onto the top face of the cup 178 as an additional means of holding the ribbon 177 in place.

The corresponding void 143 in the blade holder 158 (not shown) in the leading side of the sliding mechanism 180 directs the upper segment 179 of ribbon across the cutting edge 138 (not shown) of the blade 157 (not shown) as the sliding mechanism 180 is engaged. This void 143 extends slightly past the cutting edge 138 (not shown) of the blade 157 (not shown) to allow the user to pull the loose end 179 of the ribbon taut, and in a direction perpendicular to the sliding mechanism's direction of travel, to optimize the tension of the ribbon against the cutting edge 138 of the blade 157 for more effective cutting.

FIG. 27B illustrates the sliding mechanism in the engaged position according to the third and fourth preferred embodiments of the invention. As the assembled sliding mechanism 180 is pushed fully into the lid, the loose end 179 (not shown) of the ribbon is cut as excess. The downward pressure of the lid 183 presses against the top face of the sliding mechanism 180 and, in turn, the bottom face of the sliding mechanism 180 presses against the top face of the cup 178 to create the vertical pressure necessary to hold the ribbon 177 in place after the sliding mechanism 180 is engaged.

Figure 28:
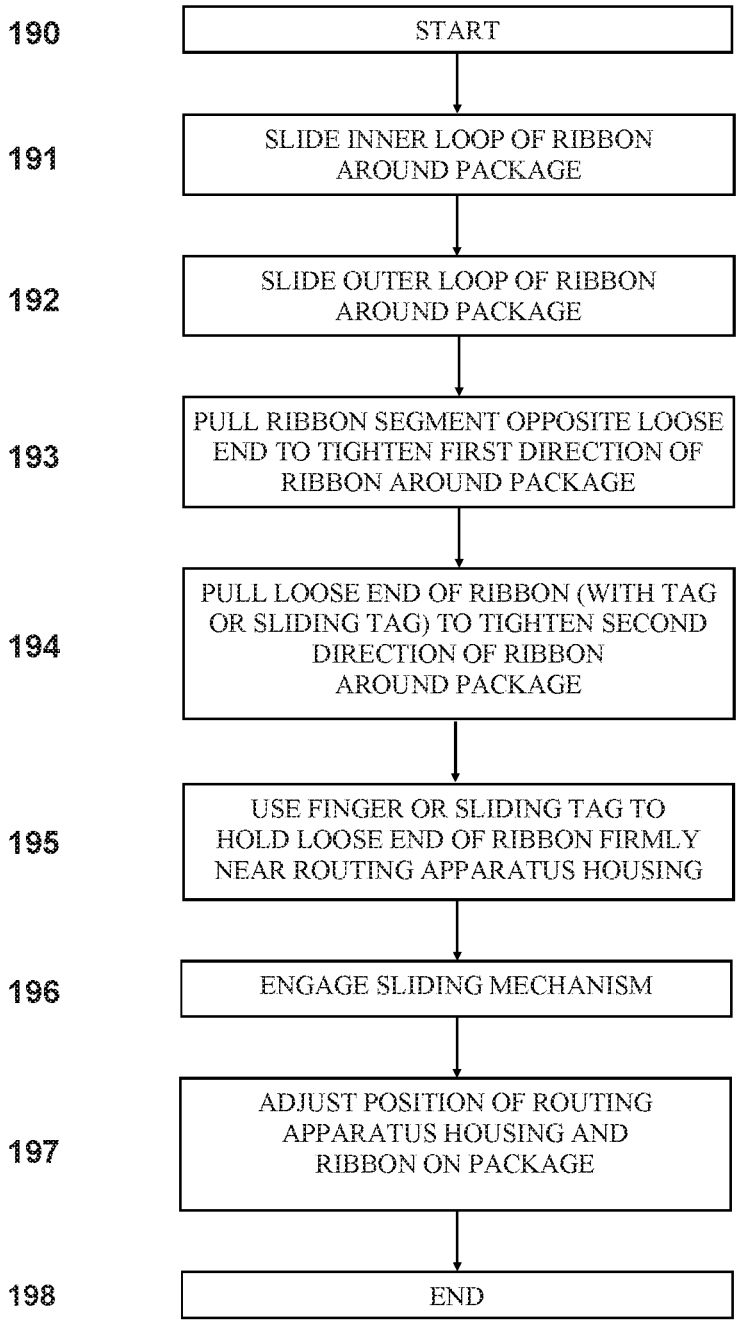
FIG. 28 provides a method flowchart for using the assembly in accordance with a third preferred embodiment of the present invention

FIG. 28 provides a method flowchart for using the assembly according to the third preferred embodiment of the invention. The process starts at block 190. At block 191, the user slides the inner loop of ribbon around the package or object being wrapped to create a single direction of ribbon encircling the package. At block 192, the user slides the outer loop of ribbon around the package to create a second direction of ribbon encircling the package substantially perpendicular to the inner loop. At block 193, the user holds the router apparatus housing in the desired location on the face of the package with one hand, and, with the other hand, pulls the segment of ribbon opposite the loose end of the ribbon away from the router apparatus housing, causing the ribbon to slide across the routing edge, until the inner loop of ribbon (perpendicular to the segment being pulled) tightens around the package. At block 194 the user pulls the loose end of the ribbon (preferably with the card stock tag or the sliding tag shown in FIGS. 41-42), causing the ribbon to slide around and across the top of the second leg of the routing apparatus, until the outer loop of ribbon tightens around the package. At this point, the single length of ribbon is taut around the package in both directions (both loops of ribbon). Because of the design of the routing apparatus and its housing, and use of a single length of ribbon, the ribbon self-adjusts to the dimensions of the package. Almost any package proportions are accommodated. At block 195, if the sliding tag is used, the user slides the sliding tag shown in FIGS. 41-42 along the length of the loose end of ribbon to the router apparatus housing as illustrated in, and described in relation to, FIG. 43. If the sliding tag is not used, the user applies pressure to the ribbon at the base of the router apparatus housing with a finger. At block 196, the user engages the sliding mechanism, preferably by grasping the rear face of the sliding mechanism with the forefinger and the opposite side of the lid with the thumb of the same hand. Engaging the sliding mechanism pinches and holds the ribbon taut around the package and cuts the loose end of the ribbon for discarding. At block 197, the user adjusts the position of the routing apparatus housing and the ribbon on the package. The process then ends at block 198.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

Fourth Preferred Embodiment

Figure 29:
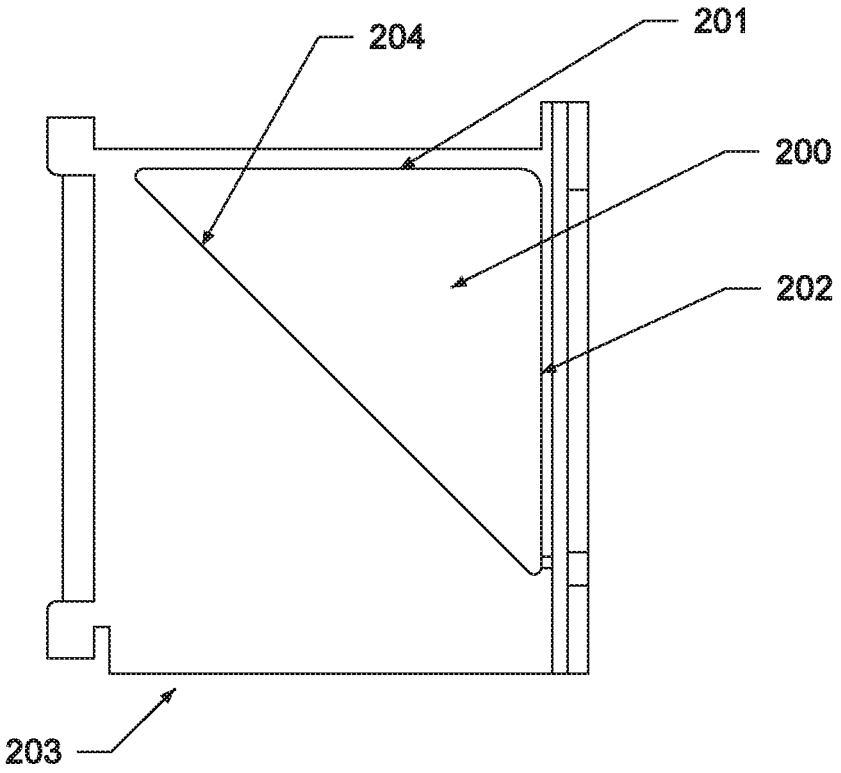
FIG. 29 is a top plan view of a ribbon routing apparatus in accordance with a fourth preferred embodiment of the present invention.
Figure 30:
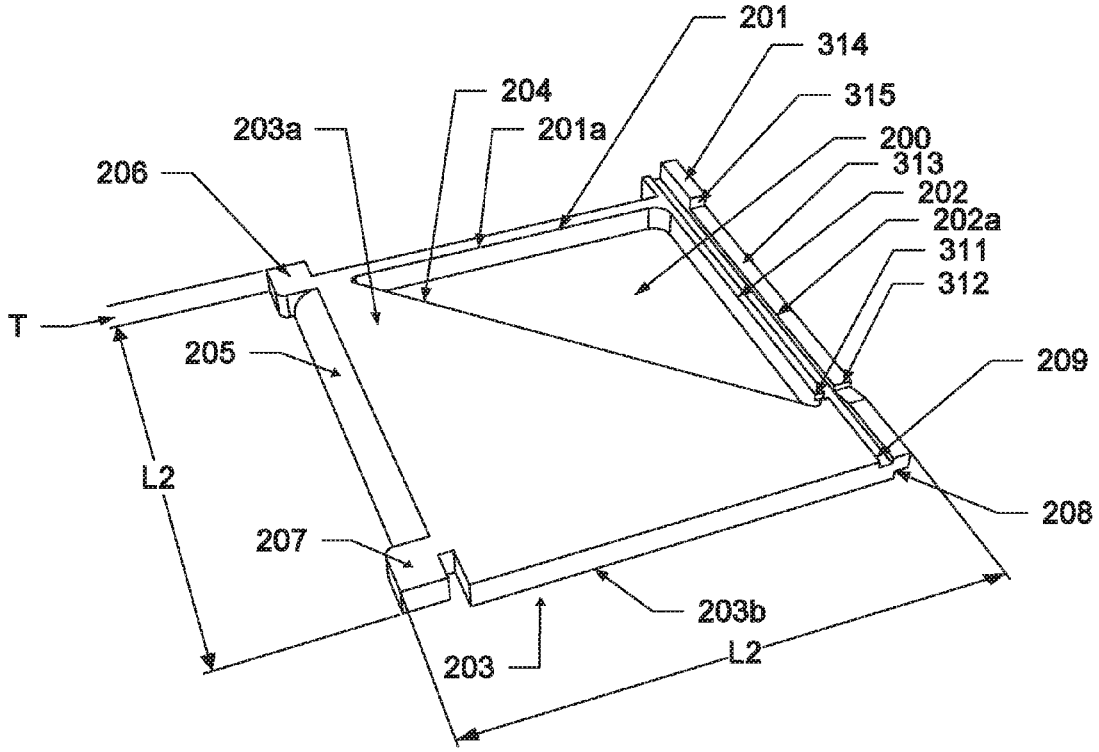
FIG. 30 is a perspective view of the ribbon routing apparatus shown in FIG. 29.
Figure 31:
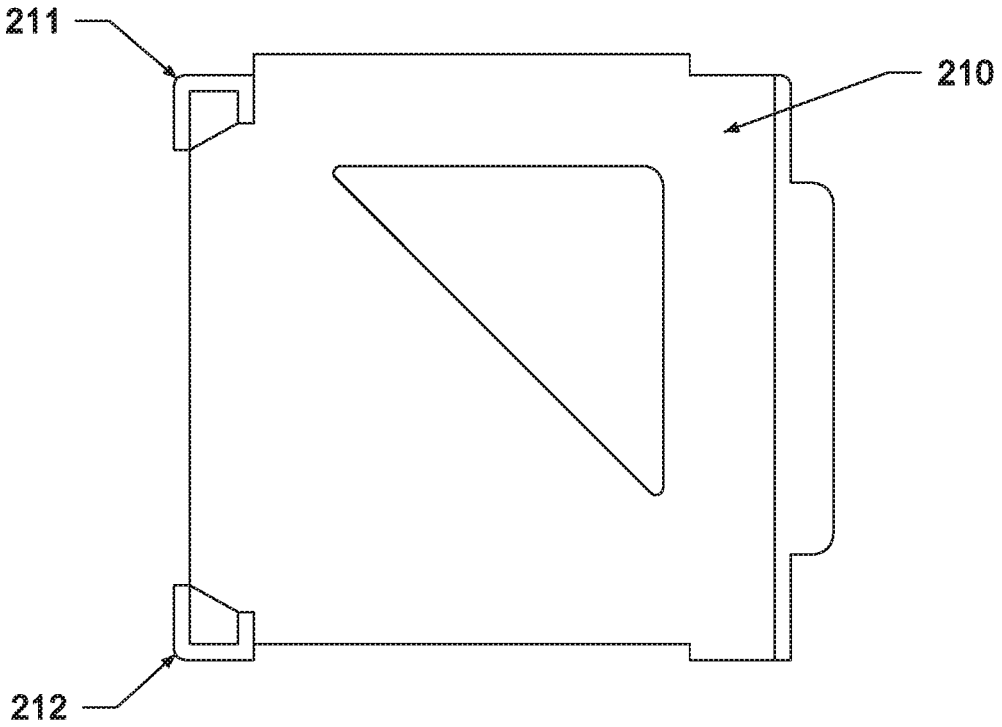
FIG. 31 is a top plan view of the lower piece of the routing apparatus housing in accordance with a fourth preferred embodiment of the present invention.
Figure 32:
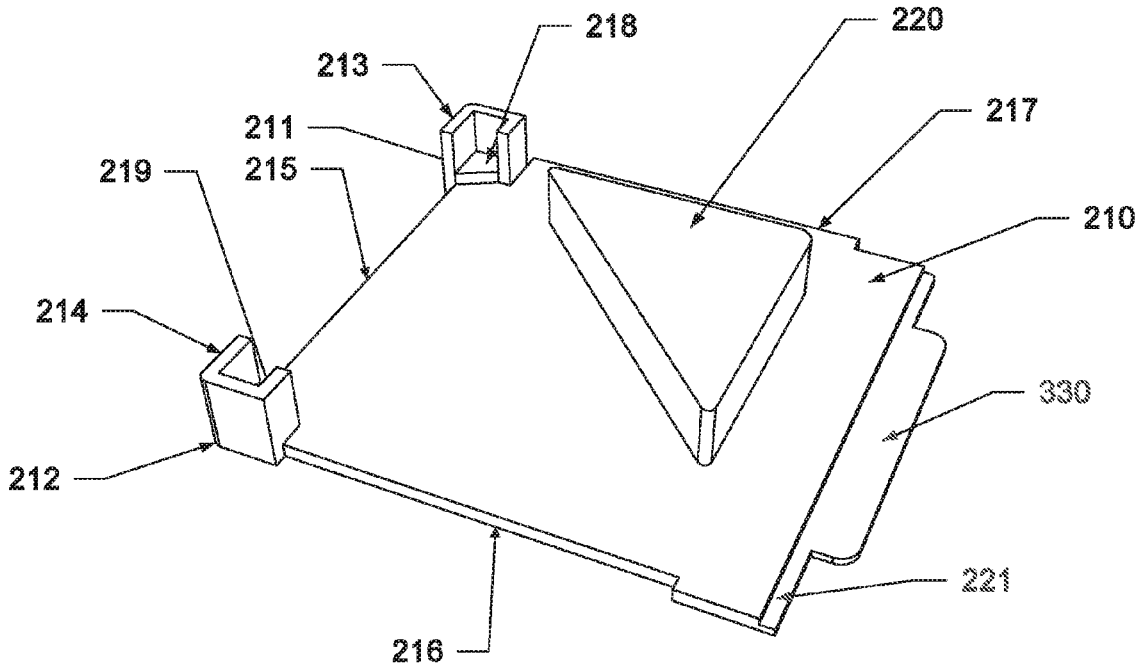
FIG. 32 is a perspective view of the lower piece of the routing apparatus housing shown in FIG. 31.
Figure 33:
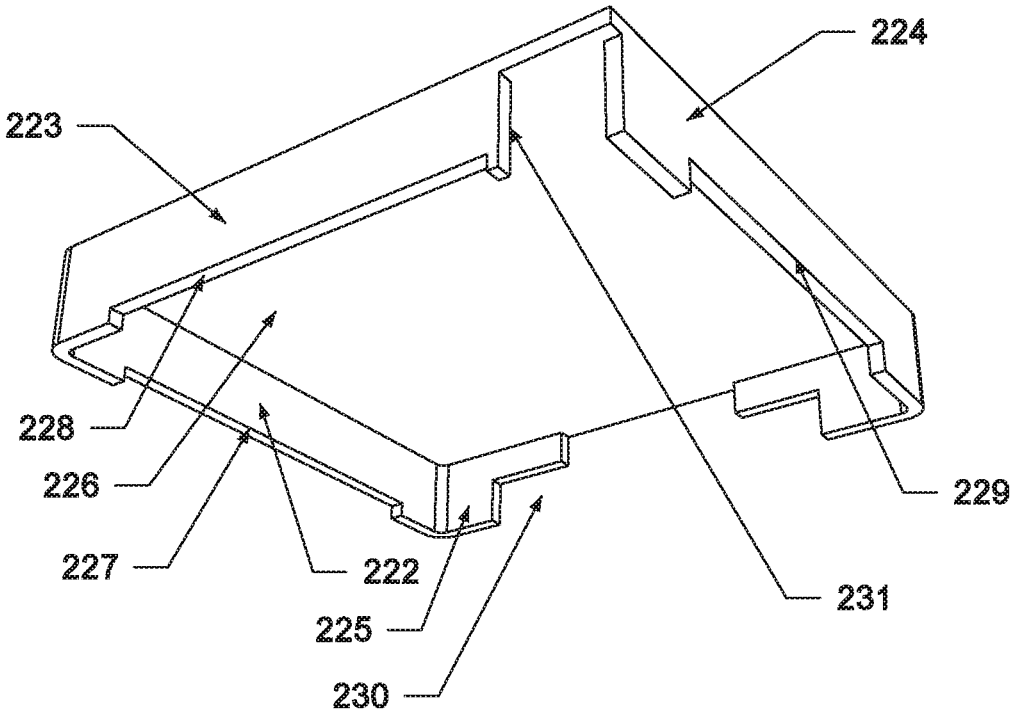
FIG. 33 is a perspective view of the upper piece of the routing apparatus housing in accordance with a fourth preferred embodiment of the present invention.
Figure 37:
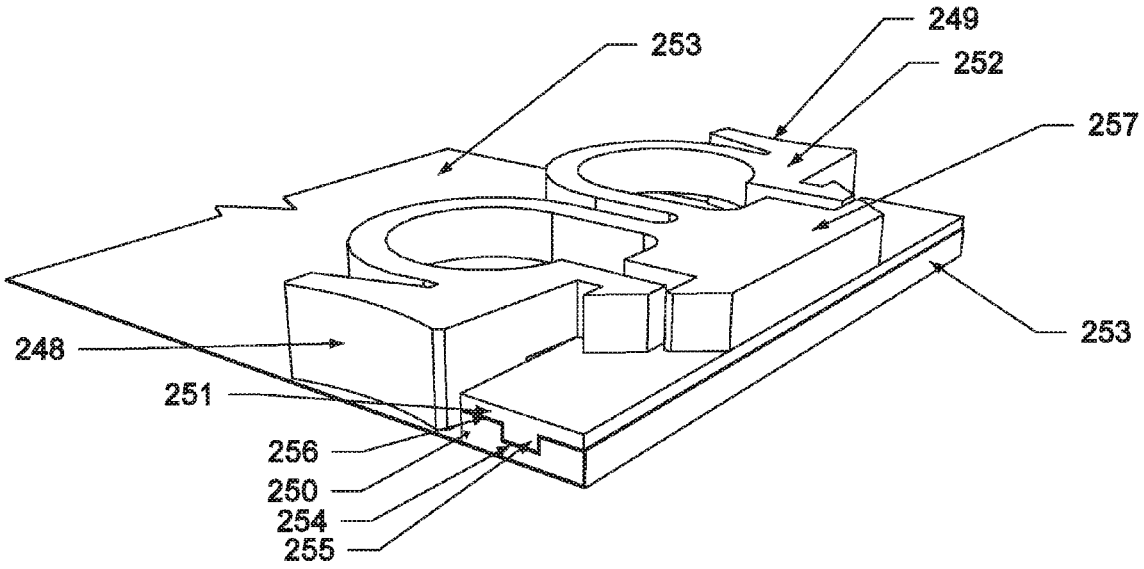
FIG. 37 illustrates the assembly of the lower plate, upper plate, and locking apparatus shown in FIGS. 34-36 to attach and detach a ribbon to the routing apparatus housing in accordance with a fourth preferred embodiment of the present invention.
Figure 38:
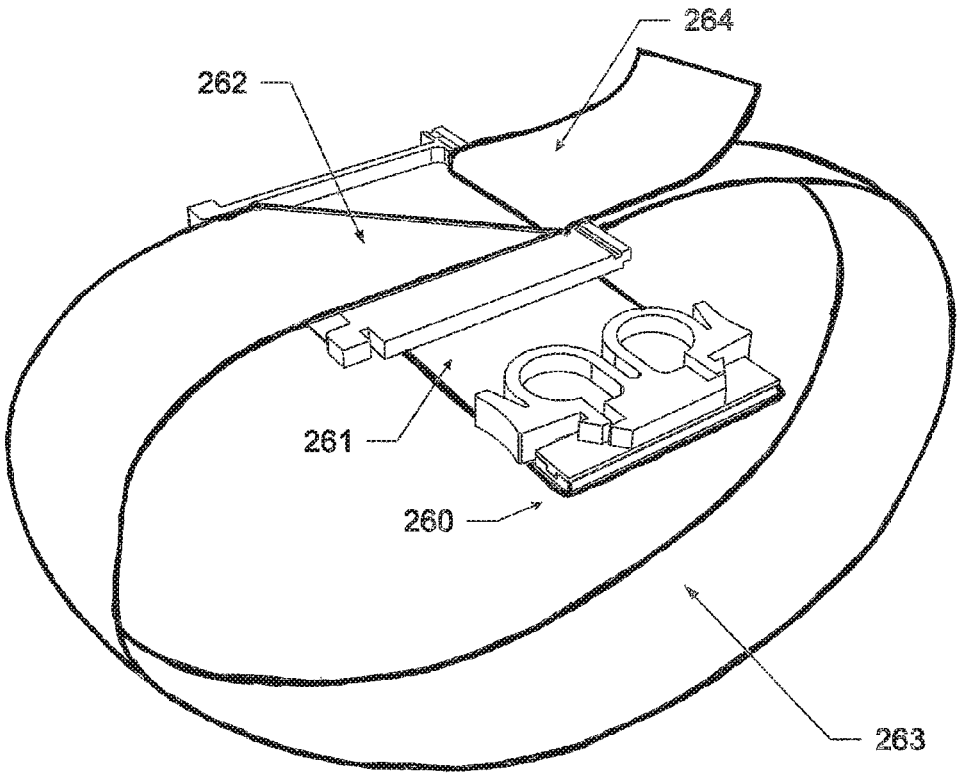
FIG. 38 illustrates a method for routing a ribbon through the routing apparatus in accordance with a fourth preferred embodiment of the present invention.
Figure 39:
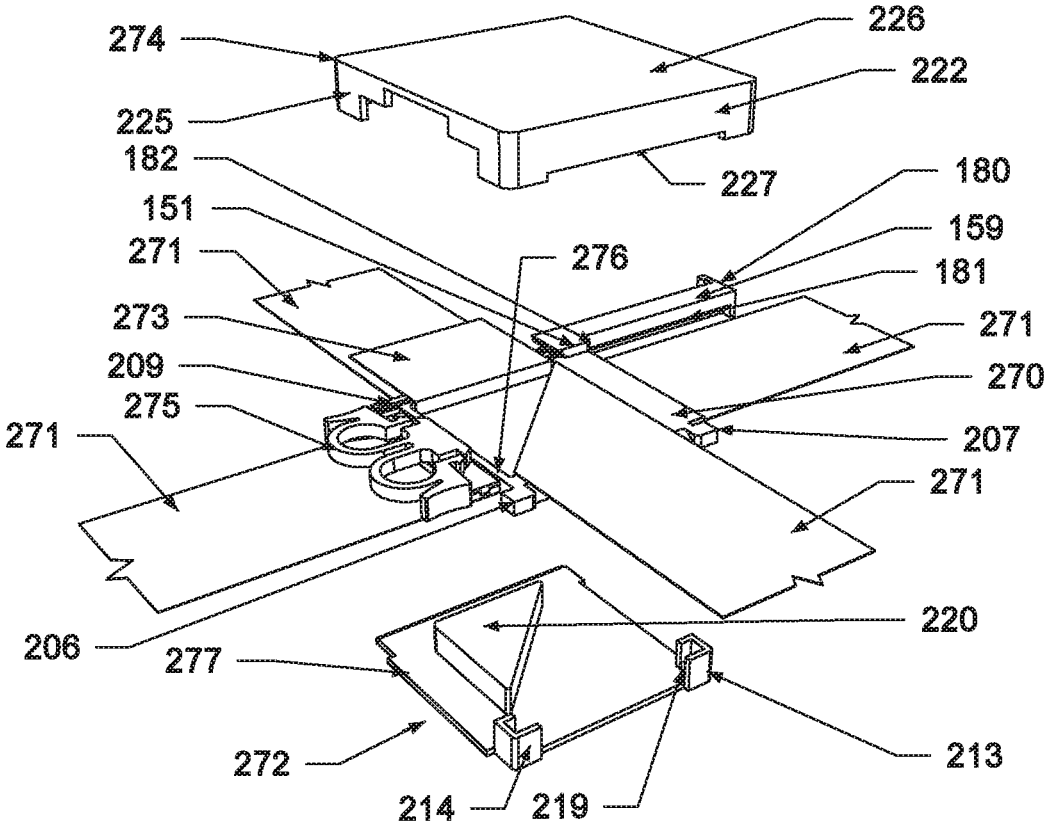
FIG. 39 illustrates the assembly of the routing apparatus, threaded ribbon, routing apparatus housing, sliding mechanism, and ribbon-attachment apparatus and assembly in accordance with a fourth preferred embodiment of the present invention.

In the fourth preferred embodiment, the invention is comprised of a single-piece routing apparatus (as shown in FIGS. 29-30), a two-piece functional housing therefor, comprised of a lower piece of the routing apparatus housing, or "cup" (as shown in FIGS. 31-32), an upper piece of the routing apparatus housing, or "lid" (as shown in FIG. 33), a sliding mechanism (as shown in FIGS. 20-24A and engaged as illustrated in FIGS. 27A-27B), and a novel apparatus and assembly (shown in FIGS. 34-37) to attach and detach one end of the ribbon to/from the routing apparatus housing. As illustrated in FIG. 38, a single length of non-elastic ribbon is routed through the routing apparatus, with neither end of the ribbon attached to the routing apparatus. As illustrated in FIG. 39, the routing apparatus, threaded with the ribbon, is combined with the cup and lid to function as an assembly, and a decorative and/or functional item is attached to the top of the lid. This assembly is used to decorate and/or secure a package or object, or a group thereof, as provided for in FIG. 40. FIGS. 41-43 show a sliding tag used to assist the user in applying consistent pressure and tension across the width of the ribbon during engagement of the sliding mechanism for more effective cutting and securing of the ribbon.

Because some of preferred embodiments of the sliding mechanism (FIGS. 20-24) used in this fourth preferred embodiment of the present invention entail cutting of the ribbon, a thin, sheer nylon ribbon, without stiffening wire, is preferred. Use of a non-elastic ribbon of nominal thickness is assumed for purposes of illustration, and not by way of limitation. Accordingly, the relative measurements illustrated herein are solely illustrative, and are not intended to limit the scope of the invention to a particular thickness or width of ribbon or a particular measurement of the components of the invention.

As in the other preferred embodiments disclosed herein, the materials from which the routing apparatus, cup, and/or lid is composed will dictate the optimal dimensions of the routing apparatus in this fourth preferred embodiment, and will likely depend on the end user's balancing of cost against minimization of the appearance of the routing apparatus' housing when placed on the package or object to be wrapped.

FIG. 29 is a top plan view of a ribbon routing apparatus in accordance with a fourth preferred embodiment of the present invention, which preferably is formed from a single piece of material substantially in the shape shown. A preferably triangular void 200 is positioned within the routing apparatus, or body 203, such that the legs 201, 202 forming the right angle are set in from the outer sides of the body 203, and the hypotenuse 204 of the triangular void 200 transverses the outer square of the body 203 substantially at a forty-five degree (45°) diagonal angle relative to the outer sides. The void 200 is preferably triangular, but is not so limited and may have nearly any size and/or shape that accommodates routing of the ribbon therethrough. The void 200 is preferably positioned within the outer square of the body 203 so that the sides 201, 202 forming the right angle are set in from the corresponding outer sides 203 of the body, and the hypotenuse 204 of the triangular void 200 transverses the body at a forty-five degree) (45° diagonal angle relative to the outer sides of the body 203. The hypotenuse 204 is not limited to being positioned at the preferred forty-five degree (45°) angle relative to the sides of the body 203 and may be positioned at nearly any angle, such as an acute angle less than forty-five degrees (45°), permitting routing of the ribbon around an object, such as a package, at angles other than ninety degrees (90°) or such that the ribbon is wrapped around a surface area of the object different from that shown in the preferred embodiments herein.

FIG. 30 is a perspective view of the ribbon routing apparatus shown in FIG. 29. As shown, two strips or legs 201*a*, 202*a* of material remain on two adjacent sides of the outer square of the body 203, preferably resembling square rods joined at a right angle, and an inner face (not shown) is formed by the hypotenuse 204 of the triangular void 200. The legs preferably include a first leg 201*a* and a second leg 202*a* that are positioned at two sides of the void 200. The first and second legs 201*a*, 202*a* preferably define first and second acute angles relative to the hypotenuse or routing edge 204. The first and second angles are preferably forty-five degrees) (45° such that the void has its preferred right isosceles triangular-shape, but is not so limited to such shape. The body 203 has a first surface 203*a* and a second surface 203*b* that define a thickness T therebetween. The first leg 201*a* also preferably defines a first length $L_1$ and the second leg 202*a* preferably defines a second length $L_2$. The first and second lengths $L_1$, $L_2$ are greater than the thickness T.

All edges over which the ribbon travels or rests or comes into close proximity are slightly rounded to avoid snagging the ribbon (for clarity, this slight rounding is not shown). One edge 205 preferably is a full quarter round between the two tabs 206, 207 shown. The inner face (not shown) of the triangular void's hypotenuse 204 preferably is a full half round (for clarity, this rounding is not shown). A first groove 208 is formed on the outside edge of the bottom face of the routing apparatus. A second groove 209 is formed slightly inset on the top face of the routing apparatus.

One small notch 311 is formed in the inner face of the topside groove 209, and another small notch 312 is formed in the outer face of the topside groove 209. The faces of these notches 311, 312 that are closest to the middle of the topside groove 209 are substantially vertical. As the sliding mechanism (180 in FIG. 27A) is engaged, the upper rail 181 (FIG. 27A) of the sliding mechanism 180 (FIG. 27A) presses the ribbon into the topside groove 209 of the routing apparatus,. and the notches 311, 312 catch the stitching on the side of the ribbon to prevent the ribbon from being pushed sideways and from bunching as the sliding mechanism is engaged (as shown in FIGS. 27A-27B). The remaining face of each notch 311, 312 is angled upward from the bottom edge of the vertical face to the top face of the routing apparatus as shown. The vertical face of the outer notch 312 is slightly closer to the middle of the topside groove 209 than is the vertical face of the inner notch 311. This slight offset allows the outer notch 312 to catch the ribbon's side stitching even if the loose end 179 of the ribbon (as shown in FIG. 27A) is pulled at an angle other than perpendicular to the bar of the routing apparatus. For the same reason, the angled face of the outer notch 312 extends further toward the outside square 104 of the routing apparatus than does the angled face of the inner notch 311. At the other end of the topside groove 209, on the thin strip 313 on the outside of the topside groove 209, a flat surface 314 is raised from the top face of the routing apparatus. The inside vertical face 315 of this raised surface 314 is positioned slightly to the outside of the loose end 273 of the ribbon 271 (both as shown in FIG. 39, not shown here) when pulled perpendicular to the bar of the routing apparatus as shown in FIG. 39. The inside vertical face 315 of the raised surface 314 stops the stitching on the side of the ribbon from sliding sideways at the end of the stroke of the sliding mechanism as it is engaged (as illustrated in FIGS. 27A-27B), forcing the loose end 273 of the ribbon 271 across the cutting edge 138 of the blade 157 of the sliding mechanism (as shown in FIG. 23).

FIG. 31 is a top plan view of the lower piece, or cup, of the routing apparatus housing according to the fourth preferred embodiment. The cup's base 210 is substantially in the shape shown. Two of the corners 211, 212 of the cup's base 210 are slightly rounded.

As shown in FIG. 32, at the two rounded corners 211, 212 of the cup's base, walls 213, 214 substantially in the shape shown are raised upward perpendicularly to the cup's base 210. All edges of the four walls preferably are slightly rounded over to avoid snagging the ribbon (for clarity, this slight rounding is not shown). Two of the sides of the cup's base are inset to create voids 215, 216 slightly wider than the ribbon, in which the ribbon will rest and/or slide. One side of the cup's base is outset to create a platform 217 slightly wider than the ribbon, on which the attachment assembly shown in FIG. 37 will rest. Within the perimeter of each of the walls 213, 214, a flat-topped surface 218, 219 is elevated from the cup's base 210. A flat-topped surface 220 substantially in the shape of a right isosceles triangle is raised up from the top face of the cup's base 210 to the same height as the walls 213, 214 at the corners of the cup. One outside edge of the cup's base 210 has a groove 221 in which the sliding mechanism (FIGS. 20-24A) will travel and in which the ribbon will be pinched and held upon engagement of the sliding mechanism (as provided for in FIGS. 27A-27B). A platform 330 extends from the groove 221 on which the sliding tag shown FIGS. 41-42 will rest (as illustrated in FIG. 43) during engagement of the sliding mechanism (as illustrated in FIGS. 27A-27B).

FIG. 33 is a perspective view of the underside of the upper piece, or lid, of the routing apparatus housing according to the fourth preferred embodiment of the invention. The lid consists of vertical walls 222, 223, 224, 225 that wrap around the perimeter of the cup, slightly offset outward from the cup to permit the lid to slide down over the cup's walls and the sliding mechanism (shown in FIGS. 20-24A). The corners of the lid's walls preferably are slightly rounded. A flat surface 226 is formed atop, and connected to, the lid's walls 222-225. From the base of two 222, 223 of the lid's walls, a void 227, 228 is formed that is slightly wider than the ribbon. From the base of one of the lid's wall 224, a higher void 229 is formed as shown. From the base of the remaining wall 225, a void 230 substantially in the shape shown is formed, which accepts the attaching and detaching apparatus and assembly, as shown in FIG. 37. On one wall 223 there is a void 231 as shown (through which the sliding apparatus and assembly will travel). All edges of the lid that come in contact with the ribbon preferably are slightly rounded to avoid snagging the ribbon (for clarity, this slight rounding is not shown).

This fourth preferred embodiment utilizes one of the preferred embodiments of the sliding mechanism described in relation to, and illustrated in, FIGS. 20-24A, 27A-27B.

FIG. 34 is a perspective view of a lower plate of an apparatus and assembly to attach and detach a ribbon to the routing apparatus housing, or "attachment mechanism," according to the fourth preferred embodiment of the invention. The lower plate of the attachment mechanism is formed from a single piece of material substantially in the shape shown. The long side 232 of the lower plate is substantially the width of the ribbon used. The short side 233 of the lower plate is substantially equal to the distance between the outer face of the routing apparatus' 270 thinnest bar 276 and the outer face of the platform 277 extending from the side of the routing apparatus' cup 272, all as shown in FIG. 39.

FIG. 35 is a perspective view of the underside of an upper plate of the attachment mechanism according to the fourth preferred embodiment of the invention. The upper plate of the attachment mechanism preferably is formed from a single piece of material substantially in the shape shown. The long side 234 and short side 235 of the upper plate of the attachment mechanism are substantially equal to the corresponding lengths of the lower plate of the attachment mechanism shown in FIG. 34.

FIG. 36 is a plan view of a locking apparatus to function within the attachment mechanism according to the fourth preferred embodiment of the invention. The locking apparatus is formed from a single piece of material substantially in the shape shown. When inserting the assembled attachment mechanism (as shown in FIG. 37) into the corresponding slot on the routing apparatus' lid (as shown in FIG. 39), the angled faces 236, 237 of the locking tabs 238, 239 cause compression of the rounded flexors 240, 241. This compression causes the locking tabs 238, 239 to slide toward the middle of the apparatus, which sliding is partially guided by flanges 242, 243 that prevent the locking tabs 238, 239 from flexing forward instead of laterally. As the attachment mechanism is pushed into the corresponding void in the lid, the angled faces 236, 237 press against the outside walls of the void in the lid, causing the locking tabs 238, 239 to slide toward the middle of the attachment mechanism. When the tips of the locking tabs 238, 239 pass the lid's wall, the locking tabs 238, 239 rebound into shape, causing the inner faces 244, 245 of the locking tabs 238, 239 to rest against the lid's inside wall. The wide faces 246, 247 of the locking apparatus prevent the sliding mechanism from sliding any further into the lid.

When removing the attachment mechanism from the lid, the user squeezes the finger pads 248, 249 to compress the rounded flexors 240, 241, which slides the locking tabs 238, 239 toward the middle of the attachment mechanism. The travel of the locking tabs 238, 239 is guided by the flanges 242, 243. The user then pulls the sliding mechanism from the lid by the squeezed finger grips 248, 249.

FIG. 37 is a perspective view of the assembly of the attachment mechanism shown in FIGS. 34-36. The attachment mechanism is comprised of a lower plate 250, an upper plate 251, a locking apparatus 252, and one end of the ribbon 253 to be routed through the routing apparatus (as shown in FIG. 38). First, an adhesive is applied to the upper faces of the lower plate 250 and upper face of the channel 254 of the lower plate 250, and is applied to the lower faces of the upper plate 251 and the lower face of the bar 255 of the upper plate 251. Second, the end 256 of the ribbon 253 is laid across the upper faces of the lower plate 250. Third, the upper plate 251 is lowered onto the lower plate 250, such that the bar 255 of the upper plate 251 pinches the ribbon 253 into the channel 254 of the lower plate 250, and the ribbon 253 adheres to the surfaces of both the lower plate 250 and the upper plate 251. Fourth, the ribbon 253 is routed under the bottom face of the lower plate 250. Fifth, an adhesive is applied to the "T" shaped area 257 on the bottom face of the locking apparatus 252. Sixth, the bottom face of the locking apparatus 252 is adhered to the top face of the upper plate 251 as shown. The portions of the locking apparatus 252 comprising the finger pads 248, 249 preferably are extended downward, nearly to the top face of the ribbon 253 passing beneath the bottom face of the locking apparatus 252, to increase the surface area of the finger pads for easier gripping. These steps yield an assembly as shown in FIG. 37.

FIG. 38 illustrates a method for routing a ribbon through the routing apparatus according to the fourth preferred embodiment of the invention. At step 260, one end of a single length of non-elastic ribbon is attached to the attachment mechanism as shown in FIG. 37. At step 261, the other end of the ribbon (extending from the rear side of the attachment mechanism) is threaded under the bottom face of the routing apparatus. At step 262, the ribbon is threaded up through the triangular void in the routing apparatus, is folded over the hypotenuse of the triangular void to the top side of the routing apparatus, turning the ribbon substantially at a right angle from its initial direction of travel. At step 263, the ribbon is then threaded from the top side of the routing apparatus, between the two tabs shown, down into space, and back up to the opposite side of the routing apparatus to create a loop beneath the routing apparatus that will ultimately wrap around the bottom of the package being wrapped in one direction. At step 264, the loose end of the ribbon approaches the routing apparatus substantially parallel to the bottom face, passes under and loops over the grooved bar of the routing apparatus, and lays back on itself in the opposite direction. As provided for in, and described in relation to FIG. 40 (but not shown here), the user pulls the attachment mechanism, bringing the first loop of the ribbon taut around the package in one direction, and wraps the attachment mechanism and ribbon around the bottom of the package to create an outer loop that crosses under the inner loop at substantially a right angle. The attachment mechanism and ribbon are threaded through holes (such as bag handles), and the attachment mechanism is inserted into the corresponding void in the routing apparatus' lid. After the attachment mechanism is secured in place, the result is ribbon emanating in four directions from the routing apparatus, with each direction of ribbon being substantially centered on, and traveling substantially perpendicular to, each side of the outer square of the routing apparatus.

FIG. 39 illustrates the assembly of the routing apparatus 270, threaded ribbon 271, cup 272, lid 274, sliding mechanism 180, and assembled attachment mechanism 275 according to the fourth preferred embodiment of the invention. The assembled sliding mechanism 275 is shown in the attached position as provided for in block 283 in FIG. 40. Once the ribbon has been threaded through the routing apparatus as shown in FIG. 36, the routing apparatus 270 and ribbon 271 are placed in the cup 272 as illustrated in FIG. 39. The tabs 206, 207 on one side of the routing apparatus 270 fit within the walls 213, 214 of the cup 272 to hold the routing apparatus 270 in position.

The interlocking of the tabs 206, 207 within the walls 213, 214 on the cup 272 holds the routing apparatus 270 in place as the ribbon 271 is pulled taut by its loose end 273 and as the sliding mechanism 180 is engaged, and prevents dislodging or misalignment of the sliding mechanism 180 as the ribbon 271 is pulled taut by its loose end 273.

The tabs 206, 207 of the routing apparatus 270 rest on the raised surfaces 218, 219 (in FIG. 32, not shown here) within the perimeter of the cup's raised walls 213, 214 to elevate two corners 206, 207 of the routing apparatus 270 within the cup 272. The purpose of elevating the routing apparatus 270 slightly is to prevent the downward pressure that is created by tightening of the ribbon 271 as it travels over the top face of the routing apparatus 270 from pressing down on the ribbon 271 routed under the bottom face of the routing apparatus 270 and pinching the ribbon and hindering its travel. The groove 209 (in FIG. 30, not shown here) in the top face of the routing apparatus 270 corresponds and accepts the inside upper rail 181 of the sliding mechanism 180. The groove 208 (in FIG. 30, not shown here) in the bottom face of the routing apparatus 270 corresponds and accepts the inward facing horizontal rail 140 (FIG. 23, not shown here) of the sliding mechanism 180. The grooves in the routing apparatus and the rails of the sliding mechanism function as described in relation to FIG. 26 to pinch and secure the ribbon at multiple points.

The leading side of the upper rail 181 and lower rail 140 of the assembled sliding mechanism 180 are placed into the corresponding upper groove 209 and lower groove 208 of the routing apparatus 270, and the assembled sliding mechanism 180 slides onto the routing apparatus 270 slightly beyond the point where the trailing edge 182 of the sliding mechanism's stop tab 151 is within the vertical perimeter of the cup's base 272. The sliding mechanism's lower rail 140 (not shown) elevates slightly the side of the routing apparatus 270 opposite the routing apparatus' tabs 206, 207.

The lid 274 is lowered down onto and around the cup 272, and the assembled sliding mechanism 180 remains in a disengaged position. The top face of the triangular surface 220 of the cup 272 is attached to the bottom face of the lid's top surface 226. Once the lid is seated and attached, the bottom faces of the voids 227, 228 (not shown), 229 (not shown) in the lower sides of three of the lid's walls 222, 223 (not shown), 224 (not shown) press the corresponding segments of the ribbon 271 flat against the top of the package or object being wrapped.

For narrow width ribbon (less than one inch in width), a tag (not shown here) made of relatively stiff material, such as paper card stock, and which is wider than the void 229 in the wall 224 of the lid 274 through which the loose end 273 of the ribbon travels, preferably is attached to the loose end 273 of the ribbon to prevent the ribbon from inadvertently being unthreaded from the routing apparatus 270. This tag attached to the loose end 273 of the ribbon will be discarded after the ribbon has been pulled taut around the package and the sliding mechanism is engaged to cut the excess ribbon, as illustrated in FIG. 27B and provided for in FIG. 28. For wider ribbon (one inch or more), the sliding tag shown in FIG. 41 (not shown here) is threaded with the ribbon as illustrated in FIG. 42. This sliding tag is wider than the void 229 in the wall 224 of the lid 274 through which the loose end of the ribbon travels, which prevents the ribbon from inadvertently being unthreaded from the routing apparatus 270.

These parts and steps result in an assembly consisting of the routing apparatus 270, with a single length of non-elastic ribbon 271 routed through and attached to the routing apparatus 270 (as illustrated in FIG. 25), the cup 178, and the lid 183. A decorative and/or functional item is attached to the top face 184 of the routing apparatus' lid, such as a decorative bow (made from the elastic ribbon material or a non-elastic ribbon material that matches the elastic ribbon material), a writing surface, a box of crayons, silk flowers, a music box, a box of chocolates, etc.

To further minimize the appearance of the routing apparatus' housing when placed on the package or object to be wrapped, the material forming the components preferably are colored to match or complement the dominant color of the ribbon used.

Figure 40:
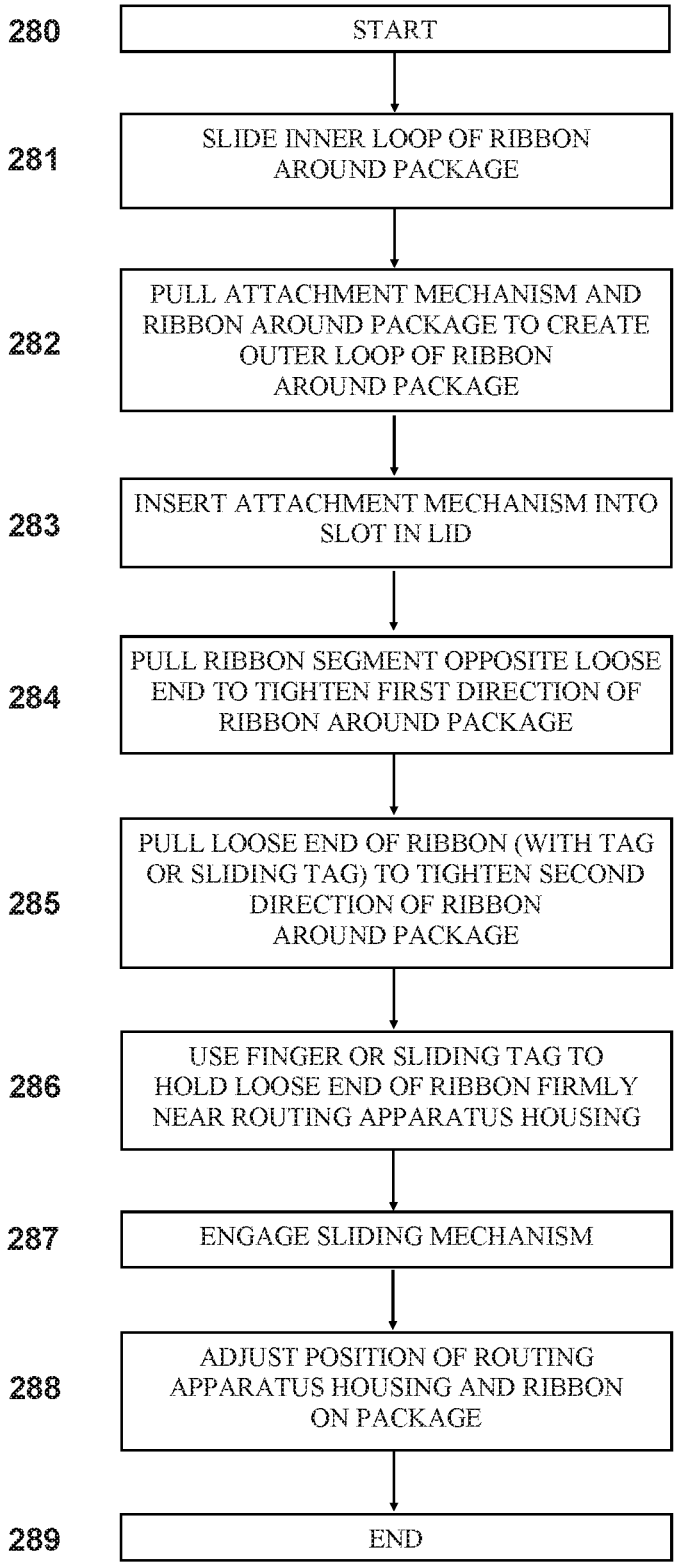
FIG. 40 provides a method flowchart for using the assembly illustrated in FIG. 39 in accordance with a fourth preferred embodiment of the present invention.

FIG. 40 provides a method flowchart for using the assembly according to the fourth preferred embodiment of the invention. The process starts at block 280. At block 281, the user slides the inner loop of ribbon around the package or object being wrapped to create a single direction of ribbon encircling the package. At block 282, the user pulls the attachment mechanism, which is followed by the ribbon, and passes the attachment mechanism and ribbon down into space and under the package or object being wrapped, crossing over the first loop of ribbon substantially at a right angle, through any voids in the package being wrapped (such as the handles of a gift bag), and back to the opposite side of the routing apparatus. At block 283, the user inserts the attachment mechanism into the slot provided in the side wall of the lid until the tabs of the locking mechanism compress and finally snap back into shape to grip the walls forming the ends of the upper narrow void in the side wall of the lid. This attaches the first end of ribbon to the routing apparatus housing. Because of the design of the routing apparatus and its housing, the ribbon self-adjusts to the dimensions of the package. Almost any package proportions are accommodated. Further, the first end of the ribbon being initially unattached permits the user to route the ribbon through otherwise inaccessible voids in the object being wrapped, such as the handles of a gift bag. At block 284, the user holds the router apparatus housing in the desired location on the face of the package with one hand, and, with the other hand, pulls the segment of ribbon opposite the loose end of the ribbon away from the router apparatus housing, causing the ribbon to slide across the routing edge, until the loop of ribbon perpendicular to the segment being pulled tightens around the package. At block 285 the user pulls the loose end of the ribbon (with either the card stock tag or the sliding tag shown in FIGS. 41-42), causing the ribbon to slide around and across the top of the second leg of the routing apparatus, until the second loop of ribbon tightens around the package. At this point, the single length of ribbon is taut around the package in both directions (both loops of ribbon). At block 286, if the sliding tag is used, the user slides the sliding tag shown in FIGS. 41-42 along the length of the loose end of ribbon to the router apparatus housing as illustrated in, and described in relation to, FIG. 43. If the sliding tag is not used, the user applies pressure to the ribbon at the base of the router apparatus housing with a finger. At block 287, the user engages the sliding mechanism, preferably by grasping the rear face of the sliding mechanism with the forefinger and the opposite side of the routing apparatus lid with the thumb of the same hand. Engaging the sliding mechanism pinches and holds the ribbon taut around the package and cuts the loose end of the ribbon for discarding. At block 288, the user adjusts the position of the routing apparatus housing and the ribbon on the package. The process then ends at block 289.

FIG. 41 is a perspective view of the underside of a sliding tag used in the third and fourth embodiments to assist in applying consistent pressure across the width of the ribbon during engagement of the sliding mechanism (as illustrated in FIGS. 27A-27B). The sliding tag is formed from a piece of material substantially in the shape shown. Two voids 331, 332 slightly wider than the width of the ribbon used are formed into the sliding tag. On the leading side 333 of the sliding tag, a flat surface 334 descends from the bottom face of the sliding tag, preferably beginning slightly toward the leading side 333 of the sliding tag from the first void 331. From the leading lower edge of the descending surface 334, there is an angled face 335 extending to the vertical face 336 on the leading side 333 of the sliding tag.

FIG. 42 illustrates a method for threading the ribbon through the sliding tag shown in FIG. 41. The loose end of the ribbon exiting the routing apparatus housing (179 in FIGS. 26 and 273 in FIG. 39) passes over the top face of the sliding tag, and is threaded down into the void 331 on the leading side of the sliding tag. The ribbon 179, 273 is then threaded up through the second void 332 of the sliding tag. After the ribbon is threaded through the sliding tag, the end of the ribbon is formed into a knot 337 to prevent the sliding tag from slipping off the loose end of the ribbon 179, 273.

FIG. 43 illustrates a method for using the sliding tag shown in FIGS. 41-42 to assist the user in applying consistent pressure across the width of the ribbon during engagement of the sliding mechanism (as illustrated in FIGS. 27A-27B). This consistency of pressure across the width of the ribbon produces more effective cutting of the ribbon and more even pinching and holding of the ribbon as the sliding mechanism is engaged (as described in relation to FIGS. 27A-27B). Specifically in relation to the third and fourth preferred embodiments of the invention, FIG. 43 is a cutaway side plan view of: the profile of the routing apparatus 176, 270, the profile of the cup 178, 272, the profile of the lid 183, 274, the profile of the assembled sliding mechanism 180 in the disengaged position (as shown in FIG. 27A) (furthest from the viewer), the sliding tag 337 shown in FIG. 42, the ribbon 177, 271, and the loose end 179, 273 of the ribbon that exits the routing apparatus housing as threaded through the sliding tag 337 (as illustrated in FIG. 42).

As provided in block 194 of FIG. 28 and block 285 of FIG. 40, the user pulls the sliding tag 337 and loose end 179, 273 of the ribbon to bring the ribbon 177, 271 taut around the package being wrapped. As provided in block 195 of FIG. 28 and block 286 of FIG. 40, the user then slides the sliding tag 337 along the loose end 179, 273 of the ribbon toward the lid 183, 274. As shown in FIG. 43, the bottom face of the descending surface 334 on the leading side 333 of the sliding tag 337 slides over the now-taut ribbon 177, 271 and up onto the platform 320, 330 extending from the side of the cup 178, 272. The angled face 335 on the lower side of the leading side 333 of the sliding tag 337 minimizes collision of the sliding tag 337 against the platform 320, 330 and ensures that the bottom descending face 334 of the sliding tag 337 is lifted onto the platform 320, 330. The thickness of the leading side 333 of the sliding tag 337 lifts the loose end 179, 273 of the ribbon pulling its width evenly across the taller void 136, 229 in the lid 183, 274. The user then applies finger pressure to the loose end 179, 273 of the ribbon at a point 338 to the trailing side of the second void 332 of the sliding tag. This finger pressure holds taut the ribbon 177, 271, which is still connected to the loose end 179, 273 of the ribbon, while the edges of the voids 331, 332 in the sliding tag 337, the upper edge of the leading vertical face 336 of the sliding tag 337, and the edges of the void 136, 229 in the lid 183, 274 maintain even pressure across the width of the loose end 179, 273 of the ribbon. This even pressure ensures effective cutting and pinching of the ribbon as the sliding mechanism 180 is engaged, as illustrated in FIGS. 27A-27B. Once the sliding mechanism 180 is engaged, which cuts the loose end 179, 273 of the ribbon and secures the ribbon 177, 271 taut around the package, the sliding tag 337 and loose end 179, 273 of the ribbon preferably are discarded.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

What is claimed is:

1. A ribbon routing assembly for routing a single length of ribbon around and securing the ribbon to an object, wherein the ribbon has a first end and a second end, the ribbon routing assembly comprising:

a body with a void, the body including a first leg configured for securing to the first end of the ribbon and a second leg configured for securing to the second end of the ribbon, the void including a routing edge that defines a first acute angle relative to the first leg and a second acute angle relative to the second leg, the first and second acute angles being approximately forty-five degrees, the body having a first surface and a second surface that define a thickness therebetween, the first leg defining a first length, the second leg defining a second length; and a lid configured for mounting to the body in a mounted configuration.

2. The ribbon routing assembly of claim 1, wherein the body is generally rigid and flat such that the first and second surfaces are generally planar.

3. The ribbon routing assembly of claim 1, wherein the void has a generally right isosceles triangle-shape.

4. The ribbon routing assembly of claim 1, wherein the void is completely contained within a peripheral edge of the body.

5. The ribbon routing assembly of claim 1, wherein the body is configured such that a first portion of the ribbon is positioned between the first end and a contact section wherein the ribbon contacts the routing edge and a second portion of the ribbon is positioned between the second end and the contact section in a mounted configuration.

6. The ribbon routing assembly of claim 1, wherein the ribbon is constructed of an elastic material.

7. The ribbon routing assembly of claim 1, wherein the lid is configured for covering the body and segments of the ribbon proximate the body in the mounted configuration.

8. The ribbon routing assembly of claim 1, further comprising:

a base having an interface for mating with the body.

9. The ribbon routing assembly of claim 8, wherein the lid has walls extending downward around the base when the lid and base are coupled together in the mounted configuration.

10. The ribbon routing assembly of claim 9, wherein the walls of the lid have voids through which four segments of ribbon emanating from the routing assembly extend.

11. The ribbon routing assembly of claim 9, wherein edges of the body and the lid that are proximate the ribbon in the mounted configuration are at least partially rounded.

12. The ribbon routing assembly of claim 9, further comprising:

a rigid beam-shaped sliding mechanism.

13. The ribbon routing assembly of claim 12, wherein the lid has a void therein through which the sliding mechanism slides outside of and parallel to the second leg.

14. The ribbon routing assembly of claim 12, wherein the body has a groove outside of and parallel to the second leg of the void of the body, and the sliding mechanism has a rail corresponding to and interlocking with the groove in an assembled configuration.

15. The ribbon routing assembly of claim 12, wherein the sliding mechanism has a finger-pull tab extending from a back face of a trailing end of the sliding mechanism.

16. The ribbon routing assembly of claim 12, wherein a leading end of the sliding mechanism contains a blade, the blade positioned such that a cutting edge of the blade points toward the leading end of the sliding mechanism.

* * * * *